US012247746B2

(12) United States Patent
Lee et al.

(10) Patent No.: US 12,247,746 B2
(45) **Date of Patent: *Mar. 11, 2025**

(54) PORTABLE HOOD

(71) Applicant: LG ELECTRONICS INC., Seoul (KR)

(72) Inventors: Taeyun Lee, Seoul (KR); Yu Na Jo, Seoul (KR); Deukwon Lee, Seoul (KR); Sang Yoon Lee, Seoul (KR); Min Kyu Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 412 days.

This patent is subject to a terminal disclaimer.

(21) Appl. No.: 17/580,751

(22) Filed: Jan. 21, 2022

(65) Prior Publication Data

US 2022/0341598 A1 Oct. 27, 2022

(30) Foreign Application Priority Data

Apr. 27, 2021 (KR) ..... 10-2021-0054478

(51) Int. Cl.
*F24C 15/20* (2006.01)

(52) U.S. Cl.
CPC ..... *F24C 15/2078* (2013.01)

(58) Field of Classification Search
CPC ..... F24C 15/2078; F24C 15/2092
USPC ..... 454/63
See application file for complete search history.

(56) References Cited

U.S. PATENT DOCUMENTS

| | | | | |
|---|---|---|---|---|
| 2,253,127 | A | 8/1941 | Koch | |
| 3,430,551 | A * | 3/1969 | Hauville | F24C 15/20 454/65 |
| 3,886,560 | A | 5/1975 | Mortensen et al. | |
| 5,603,562 | A | 2/1997 | Huang | |
| 6,497,738 | B2 | 12/2002 | Lin | |
| 7,380,759 | B1 | 6/2008 | Whiteside et al. | |
| 7,662,035 | B1 * | 2/2010 | Parker | F24F 7/025 416/246 |
| 9,624,944 | B2 | 4/2017 | Ojeda | |
| 2002/0088211 | A1 | 7/2002 | Lin | |
| 2003/0033937 | A1 | 2/2003 | Najm | |
| 2004/0129139 | A1 | 7/2004 | Schumacher | |
| 2007/0204854 | A1 | 9/2007 | Morton | |
| 2016/0281742 | A1 | 9/2016 | Rivera | |

(Continued)

FOREIGN PATENT DOCUMENTS

| | | |
|---|---|---|
| CN | 202109563 | 1/2012 |
| CN | 108397808 | 8/2018 |

(Continued)

OTHER PUBLICATIONS

U.S. Notice of Allowance dated Nov. 17, 2023 issued in U.S. Appl. No. 17/584,630.

(Continued)

*Primary Examiner* — Allen R. B. Schult
(74) *Attorney, Agent, or Firm* — KED & ASSOCIATES

(57) ABSTRACT

A portable hood may include a base, a head, a column, and a fan. The head may introduce air thereinto and discharge the introduced air to the outside. The column may be coupled eccentrically to a side of the head in a horizontal direction. Further, the fan may be located inside of the head such that the fan is eccentric to the head toward the column.

19 Claims, 33 Drawing Sheets

(56) References Cited

U.S. PATENT DOCUMENTS

| | | | |
|---|---|---|---|
| 2020/0398207 | A1 | 12/2020 | Park et al. |
| 2021/0121816 | A1 | 4/2021 | Kim et al. |
| 2022/0042714 | A1 | 2/2022 | Lee |
| 2022/0282874 | A1 | 9/2022 | Jo et al. |
| 2022/0341598 | A1 | 10/2022 | Lee et al. |
| 2022/0373190 | A1 | 11/2022 | Lee et al. |

FOREIGN PATENT DOCUMENTS

| | | | |
|---|---|---|---|
| CN | 110360631 | | 10/2019 |
| CN | 112283774 | | 1/2021 |
| CN | 112555922 | | 3/2021 |
| DE | 3503236 | | 8/1986 |
| DE | 10 2004 055947 | | 7/2006 |
| DE | 10 2005 055 029 | | 5/2007 |
| DE | 20 2015 106 627 | | 1/2016 |
| DE | 20 2016 002873 | | 7/2016 |
| EP | 3 502 572 | | 6/2019 |
| FR | 2 761 620 | | 10/1998 |
| JP | 48-97490 | | 11/1973 |
| JP | 62-17737 | | 2/1987 |
| JP | 2002-286268 | | 10/2002 |
| KR | 20-0321802 | | 7/2003 |
| KR | 20-0394656 | | 9/2005 |
| KR | 10-0819482 | | 4/2008 |
| KR | 10-2016-0104514 | | 9/2016 |
| KR | 10-2017-0105333 | | 9/2017 |
| KR | 10-2017-0137335 | | 12/2017 |
| KR | 10-2018-0058047 | | 5/2018 |
| KR | 10-2018-0099392 | | 9/2018 |
| KR | 10-2018-0099393 | | 9/2018 |
| KR | 20-0487625 | | 12/2018 |
| KR | 10-1961013 | | 3/2019 |
| KR | 10-1962730 | | 3/2019 |
| KR | 10-2019-0087809 | | 7/2019 |
| KR | 10-2051551 | | 12/2019 |
| KR | 2051551 | B1 * | 12/2019 ..... F24C 15/2035 |
| KR | 10-2021-0022253 | | 3/2021 |
| KR | 10-2022-0018280 | | 2/2022 |

OTHER PUBLICATIONS

European Office Action issued in Application No. 22152272.5 dated Jun. 14, 2023.

European Search Report issued in Application No. 22 153 079.3 dated Feb. 12, 2024.

United States Office Action dated Mar. 17, 2023 issued in co-pending related U.S. Appl. No. 17/584,630.

International Search Report issued in Application No. PCT/KR2022/000188 dated Apr. 18, 2022.

International Search Report issued in Application No. PCT/KR2022/000995 dated Apr. 22, 2022.

Partial European Search Report issued in Application No. 22152272.5 dated Jun. 20, 2022.

European Search Report issued in Application No. 22153079.3 dated Jun. 28, 2022.

International Search Report dated Mar. 24, 2022 issued in PCT Application No. PCT/KR2021/019328.

European Search report issued in Application No. 22158438.6 dated Jul. 22, 2022.

European Search Report dated Nov. 3, 2022 issued in EP Application No. 22152272.5.

U.S. Office Action dated Sep. 18, 2024 issued in U.S. Appl. No. 17/677,035.

U.S. Appl. No. 17/580,751, filed Jan. 21, 2022.

U.S. Appl. No. 17/677,035, filed Feb. 22, 2022.

U.S. Appl. No. 18/443,691, filed Feb. 16, 2024.

* cited by examiner

PORTABLE HOOD

CROSS-REFERENCE TO RELATED APPLICATION(S)

The present application claims priority to Korean Patent Application No. 10-2021-0054478, filed in Korea on Apr. 27, 2021, the entire contents of which is hereby incorporated by reference.

BACKGROUND

1. Field

A portable hood, and more particularly, a portable hood which is used while food is cooked is disclosed herein.

2. Background

Generally, a hood is installed above a heating appliance for cooking such as a gas stove or induction cooker, and draws, for example, odors, water vapor, oil vapor, or fine dust thereto (hereinafter, referred to as "oil vapor") which is generated during cooking of food or other items (hereinafter, collectively "food") by the heating appliance and discharges it to the outside. An installation position of the heating appliance, such as a gas stove or induction cooker, is fixed, so the installation position of the hood installed above the heating appliance is also generally fixed.

As described above, a fixed hood installed above the heating appliance is generally installed at a position somewhat higher than the heating appliance for a kitchen structure or convenience in cooking. Accordingly, a distance between an actual cooking location and a suction inlet of the fixed hood is far, so oil vapor generated during cooking may not all be removed through the hood. Accordingly, the oil vapor not removed by the hood may flow into a room and cause odor or cause stains on walls or furniture. In addition, the existing fixed hood may be used in a fixed heating appliance, such as a gas stove or induction cooker, but cannot be used when meat is grilled by a portable burner placed on a dining table or in a living room, or when cooking is performed outdoors as in camping.

BRIEF DESCRIPTION OF THE DRAWINGS

Embodiments will be described in detail with reference to the following drawings in which like reference numerals refer to like elements, and wherein.

DETAILED DESCRIPTION

Figure 1:
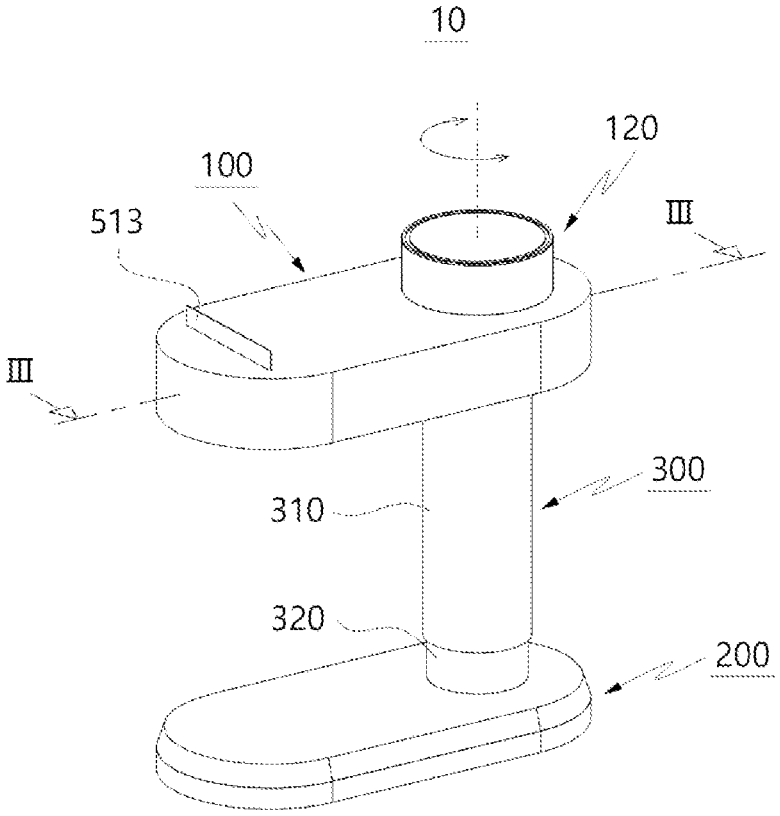
FIG. 1 is a perspective view of a portable hood according to an embodiment.

Advantages and features of embodiments and methods of achieving them will become apparent with reference to the embodiments described below in conjunction with the accompanying drawings. However, embodiments are not limited to the embodiments disclosed below, but may be implemented in various forms, and the embodiments are only provided so that the disclosure is complete, and to fully inform those skilled in the art to which the embodiments pertain, and the embodiments are defined only by the scope of the claims. The same reference numerals refer to the same elements throughout the specification.

Figure 3:
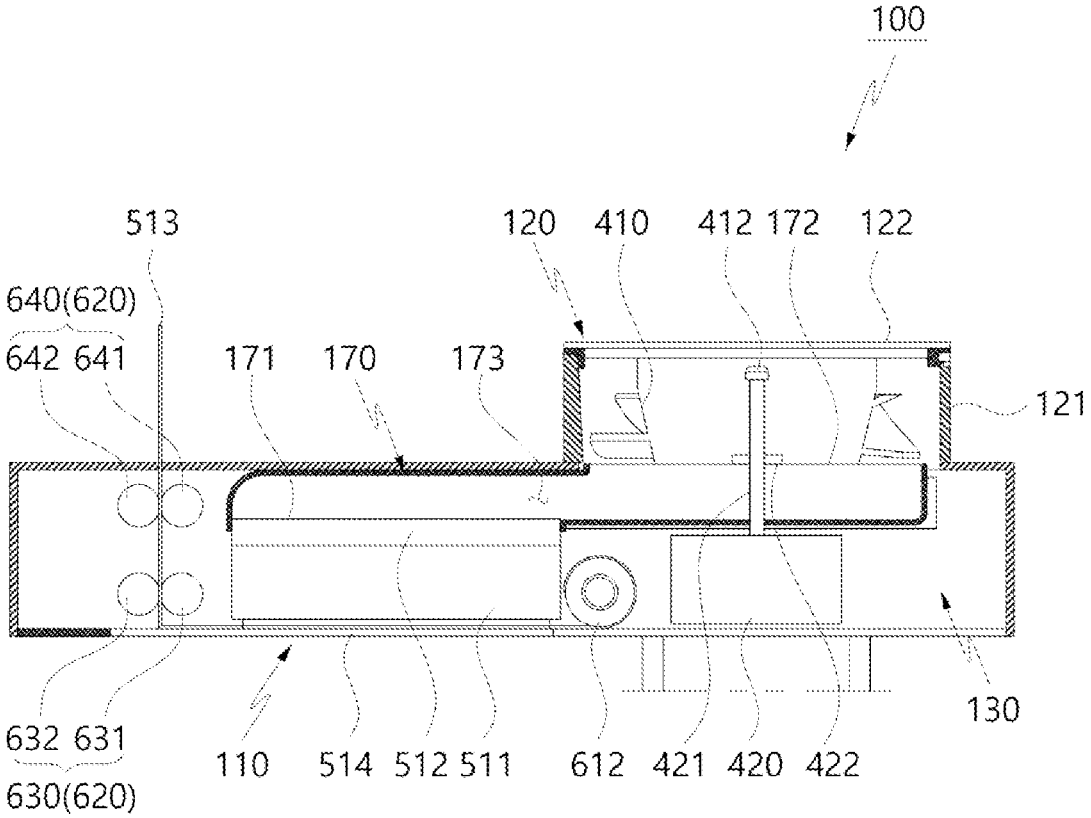
FIG. 3 is a cross-sectional view of a head, taken along line III-Ill of FIG. 1 according to an embodiment.

As illustrated in FIG. 1, a portable hood 10 according to an embodiment may include a head unit or head 100, a base unit or base 200, a columnar unit or column 300, and a fan unit or fan 410 and 420 (see FIG. 3).

The base 200 according to an embodiment may sit on a foundation. In this embodiment, it is exemplified that a shape of a flat surface of the base 200 has a shape of an oblong racetrack; however, embodiments are not limited thereto.

The head 100 may allow air to be introduced thereto and then may discharge the introduced air to the outside. The column 300 may connect the head 100 with the base 200 such that the head 100 is spaced apart upward from the base 200. In this embodiment, the column 300 is coupled to the head 100 horizontally biased.

The fan 410 and 420 may be installed inside of the head 100 and may be located biased to a horizontal side of the head 100 corresponding to the column 300. Accordingly, although the column 300 is coupled to the head 100 such that the column 300 is biased horizontally relative to the head 100, a center of weight of the portable hood 10 may be formed at a side of the column 300. Accordingly, the portable hood 10 according to this embodiment may maintain a stable standing state due to the center of weight of the portable hood 1 being at the side of the column 300, so tipping over of the portable hood 10 may be prevented.

The fan 410 and 420 according to this embodiment will be described hereinafter.

The head 100 may include a suction inlet 110 and a discharge outlet 120. Air may be introduced into the suction inlet 110 according into this embodiment. Further, the air introduced into the suction inlet 110 may be discharged through the discharge outlet 120 to the outside.

In this embodiment, as illustrated in FIG. 1, the suction inlet 110 and the discharge outlet 120 may be formed eccentrically to each other in a horizontal direction relative to a vertical direction. That is, air may be introduced at a side in the horizontal direction relative to the head 100 and may be discharged through the discharge outlet 120 biased from the suction inlet 110 in the horizontal direction. In this embodiment, the discharge outlet 120 is located biased in a direction toward the column 300 relative to the suction inlet 110.

With this configuration, bypassing of air occurring when the suction inlet 110 and the discharge outlet 120 are located on a same axis in a vertical direction, that is, a flow of air in a direction toward the discharge outlet 120 along an outside boundary of the head 100 due to failure of the introduction of some of the air to the suction inlet 110 due to the flow of air discharged through the discharge outlet 120 or cooking heat may be prevented, so that efficiency of drawing air may be improved.

In this embodiment, for example, the head 100 may have the oblong racetrack shape corresponding to a shape of the base 200, and the suction inlet 110 may be formed at a first side of the head 100 in a horizontal direction, and the discharge outlet 120 may be formed at a second side thereof. Further, the column 300 may be eccentrically coupled to the head 100 such that the column 300 is located at a side of the discharge outlet 120. In addition, the column 300 may be rotatably coupled to the base 200 such that the suction inlet 110 is rotatable side to side in the horizontal direction. With this configuration, the head 100 may rotate relative to the column 300, which functions as a shaft of the head 100, the column 300 being coupled to a side of the discharge outlet 120, and the suction inlet 110 eccentric from the discharge outlet 120 in the horizontal direction may rotate horizontally, so that a position of the suction inlet 110 may be adjusted.

Figure 2A:
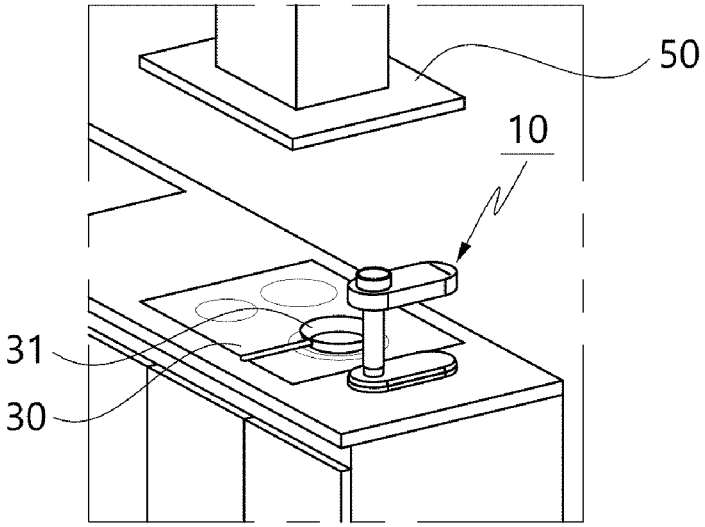
FIGS. 2A, 2B, and 2C are views illustrating states of use of the portable hood according to an embodiment.
Figure 2B:
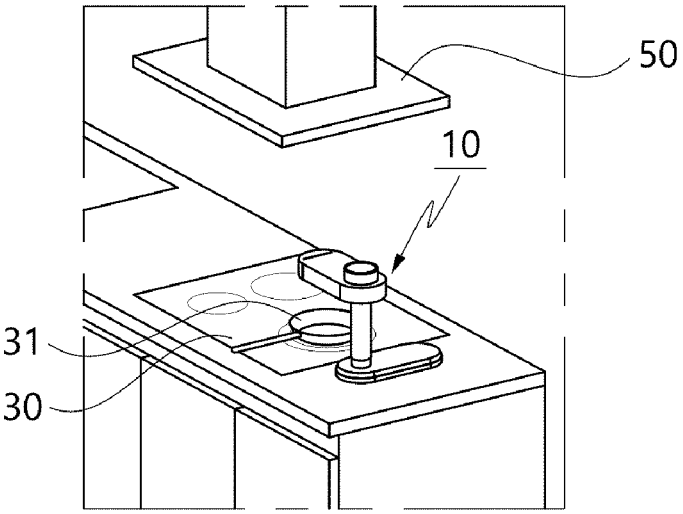
Figure 2C:
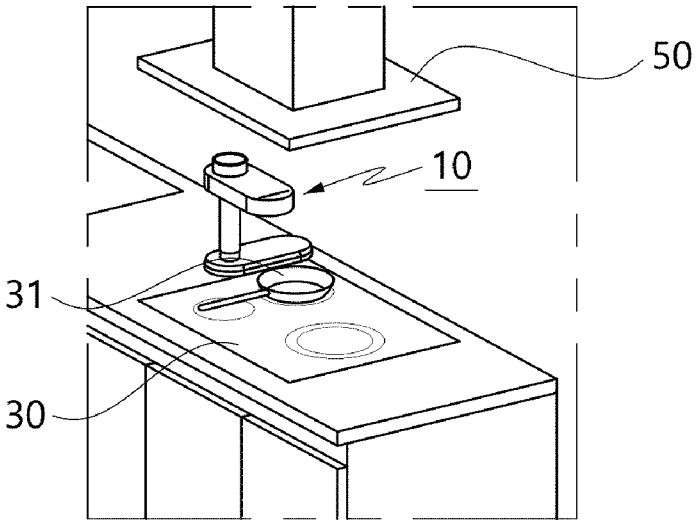

FIGS. 2A, 2B, and 2C are views illustrating states of use of the portable hood according to an embodiment. The states of use of the portable hood illustrated in FIGS. 2A, 2B, and 2C illustrates use of the portable hood in a kitchen in a general household in which a fixed hood 50 is fixed just as an induction cooker is fixed.

Referring to FIGS. 2A, 2B, and 2C, when the portable hood 10 according to an embodiment is not used, as illustrated in FIG. 2A, the head 100 may be rotated such that the head 100 and the base 200 face each other so as to minimize space occupied by the base 200 and the head 100. In addition, as illustrated in FIGS. 2B and 2C, in a state in which the portable hood 10 according to an embodiment is seated at a left (first) or right (second) side of a heating appliance 30 according to a position of a burner being used among burners of the heating appliance 30, such as an induction cooker, the head 100 may be adjusted to be rotated in a lateral (left or right) direction such that the suction inlet 110 of the head 100 is located above a cooking utensil 31, such as a pot.

Accordingly, the suction inlet 110 may be adjusted to be located adjacent to an upper portion of the cooking utensil 31 according to a cooking environment, such as the position of the burner being used, and thus, oil vapor may be introduced into the suction inlet 110 at the position adjacent to the upper portion of the cooking utensil 31, so that efficiency of drawing oil vapor may be effectively increased.

FIG. 3 is a cross-sectional view of a head according to an embodiment. The cross-sectional view illustrated in FIG. 3 illustrates a section in an eccentric direction of a suction inlet and a discharge outlet.

The suction inlet 110 according to this embodiment may be open downward and may introduce air thereinto from a position located under the suction inlet 110. Further, the discharge outlet 120 may be open upward and may discharge air introduced through the suction inlet 110 in an upward direction.

With this configuration, as illustrated in FIGS. 2A, 2B, and 2C, in a state in which the suction inlet 110 is located adjacent to the upper portion of the cooking utensil 31, the suction inlet 110 may introduce oil vapor thereinto from a lower side of the suction inlet 110 so as to improve efficiency of drawing air. Further, the introduced the oil vapor may be discharged in the upward direction through the discharge outlet 120 located at a position eccentric from the suction inlet 110 in the horizontal direction, and as described above, the bypassing of air caused by air discharged through the discharge outlet 120 or cooking heat of the cooking utensil 31 may be prevented.

In addition, the discharge outlet 120 may be configured to discharge oil vapor upward. Accordingly, as illustrated in FIGS. 2A, 2B, and 2C, the oil vapor may be discharged in a direction toward the fixed hood 50, whereby the portable hood 10 may effectively remove oil vapor generated during cooking in cooperation with the fixed hood 50.

The suction inlet 110 and the discharge outlet 120 may be formed in the head 100 such that the suction inlet 110 and the discharge outlet 120 are eccentrical so as not to overlap vertically. Accordingly, the flow of air introduced into the suction inlet 110 and the flow of air discharged from the discharge outlet 120 may not affect each other, so that efficiency of drawing and discharging air may be improved.

As illustrated in FIG. 3, the fan 410 and 420 of the portable hood 10 according to this embodiment may include a discharge fan 410.

The discharge fan 410 according to this embodiment may be installed in the discharge outlet 120. Further, the discharge fan 410 may generate a drawing force such that air is introduced through the suction inlet 110 and discharged to the discharge outlet 120.

The discharge fan 410 may be installed at the discharge outlet 120, whereby the center of weight of the portable hood 10 may be formed at the side of the column 300 at which the discharge outlet 120 is formed. Accordingly, as illustrated in FIGS. 2A, 2B, and 2C, even if the suction inlet 110 of the head 100 rotates in the horizontal direction, the center of weight of the portable hood 10 may be located at the side of the column 300, so that even when the head 100 rotates horizontally, the portable hood 10 according to an embodiment may be prevented from tipping over.

In addition, the fan 410 and 420 according to an embodiment of the present disclosure may further include a fan motor 420. In this embodiment of the present disclosure, the fan motor 420 may be installed under the discharge fan 410 and may rotate the discharge fan 410.

That is, the discharge fan 410 and the fan motor 420 may be installed in the head 100 such that the discharge fan 410 and the fan motor 420 are located at the side of the column 300, for example, at the upper side of the column 300 as illustrated in FIG. 3, so as described above, the center of an entire weight of the portable hood 10 may be formed at the column 300, whereby tipping over of the portable hood 10 may be prevented.

In this embodiment, the fan motor 420, the discharge fan 410, and the column 300 may be installed such that central axes of the fan motor 420, the discharge fan 410, and the column 300 correspond to each other. Further, as illustrated in FIG. 3, the discharge fan 410 and a rotational shaft of the fan motor 420 are configured to extend in the vertical direction. Furthermore, the discharge fan 410 and the fan motor 420 may be installed in the head 100 such that the rotational shaft is located inside of the column 300. Accordingly, the center of weight of the portable hood 10 may be formed to be adjacent to the column 300.

Figure 4:
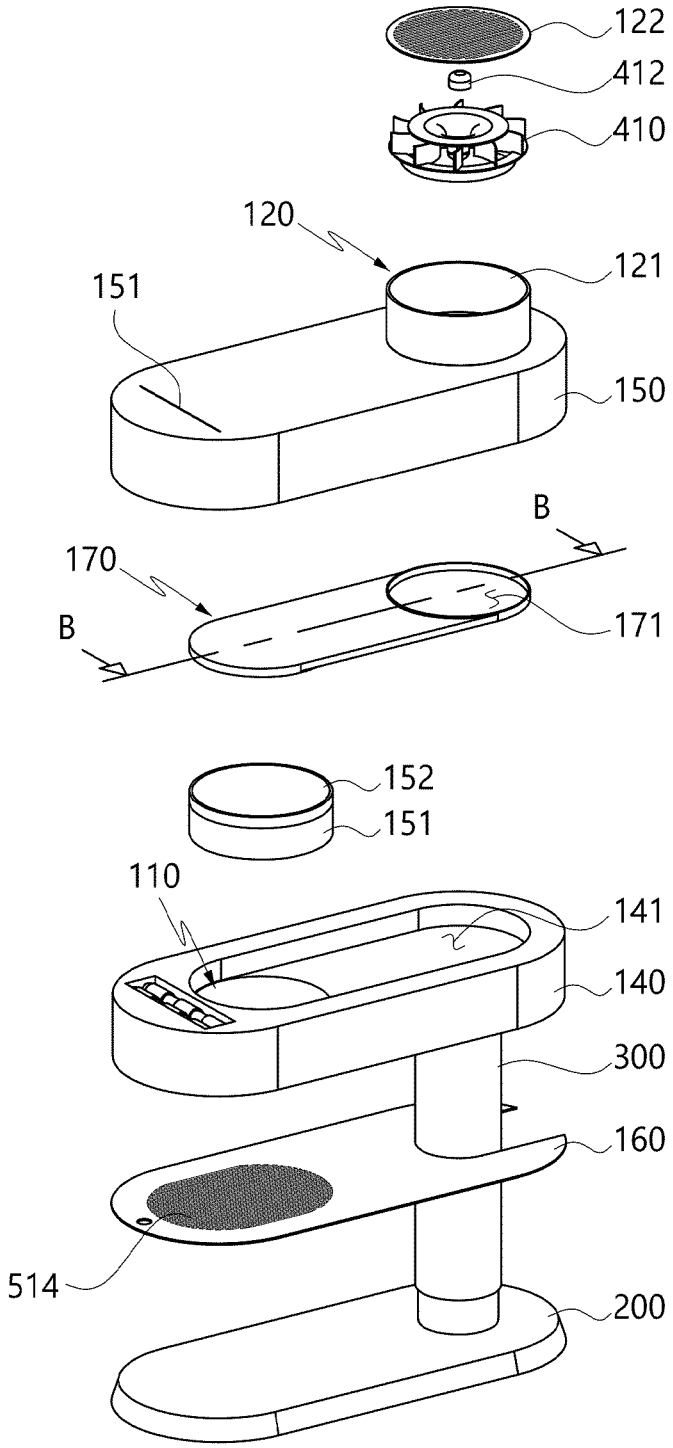
FIG. 4 is a partial exploded perspective view of the portable hood according to an embodiment.

FIG. 4 is a partial exploded perspective view of the portable hood according to an embodiment. FIG. 4 illustrates a disassembled state of a portion of the head 100 of the portable hood 10. Referring to FIG. 4, the head 100 according to this embodiment may include a head main body 130 and a flow path 170.

The suction inlet 110 and the discharge outlet 120 described above may be formed at the head main body 130 such that the suction inlet 110 and the discharge outlet 120 are eccentric in the horizontal direction. The flow path 170 according to this embodiment may be provided in the head main body 130 and may be a flow path through which air introduced through the suction inlet 110 flows to the discharge outlet 120.

Figure 5:
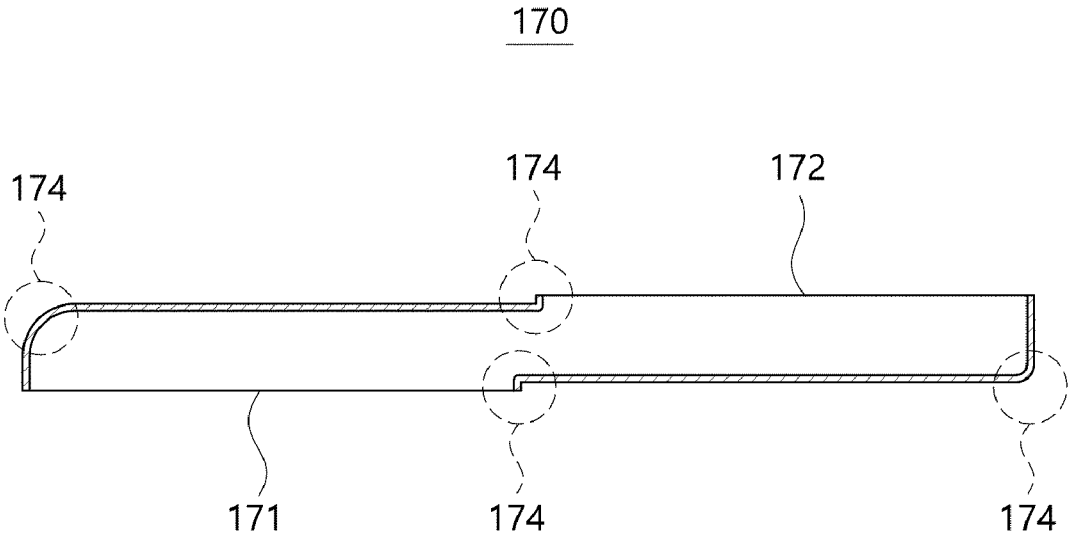
FIG. 5 is a cross-sectional view of a flow path, taken along line V-V of FIG. 4 according to an embodiment.

FIG. 5 is a cross-sectional view of a flow path, taken along line V-V of FIG. 4 according to an embodiment. Referring to FIG. 5, for an example, flow path 170 according to an embodiment may include an inlet 171, an outlet 172, and an inner flow path 173.

The inlet 171 may be formed by being open downward toward the suction inlet 110 of the head main body 130. Further, the outlet 172 may be formed by being open upward toward the discharge outlet 120 of the head main body 130. Furthermore, the inner flow path 173 may provide communication between the inlet 171 and the outlet 172 in the horizontal direction.

In this embodiment, as illustrated in FIGS. 4 and 5, the flow path 170 is a container-shaped member having the inlet 171, the outlet 172, and the inner flow path 173 and may be installed inside of the head main body 130. A flow space 141 in which the flow path 170 sits may be formed in the head main body 130, as illustrated in FIG. 4.

In the embodiment illustrated in FIGS. 4 and 5, the flow path 170 is provided as a separate member and is installed in the flow space 141 inside of the head main body 130; however, the head main body 130 may include the inlet 171, the outlet 172, and the flow path 170 having the inner flow path 173 formed inside of the head main body 130 through processing of an inside of the head main body 130.

As illustrated in FIG. 5, at an inner wall surface of the inner flow path 173, an edge portion or edge 174 in which a flow direction of air is changed may be configured to have a round shape, so as to minimize flow loss of air generated when the air flowing through the flow path 170 collides with the wall surface.

A cross-sectional area of the discharge outlet 120 may be wider than a cross-sectional area of the flow path 170, in particular, a cross-sectional area of the inner flow path 173. In general, flow loss may be caused by expansion or contraction of a flow path. When a flow path expands or contracts, flow loss may be minimized in a case in which the cross-sectional area of the discharge outlet 120 is wider than the cross-sectional area of the flow path 170.

In this embodiment, the discharge fan 410 and the fan motor 420 may be installed in the head main body 130 such that the discharge fan 410 and the fan motor 420 are located at an upper side and a lower side, respectively, of the outlet 172 of the flow path 170. More specifically, as illustrated in FIG. 3, the discharge fan 410 may be installed in the head main body 130 such that the discharge fan 410 is located at the upper side of the outlet 172 of the flow path 170. Further, the fan motor 420 may be installed in the head main body 130 such that the fan motor 420 is located at the lower side of the outlet 172 of the flow path 170.

With this configuration, in a process in which oil vapor introduced through the suction inlet 110 is discharged to the discharge outlet 120 through the flow path 170, the oil vapor may be discharged to the outside without passing through the fan motor 420 installed under the flow path 170, so that contamination of the fan motor 420 by the oil vapor may be prevented. Accordingly, in a process of disassembling the portable hood 10 to wash the portable hood 10 it is not necessary to disassemble the fan motor 420, so that the process of the dissembling and washing of the portable hood may be simplified.

As illustrated in FIG. 4, the head main body 130 according to an embodiment may include a casing main body 140, an upper casing 150, and a lower casing 160. In the casing main body 140 according to an embodiment, the inlet 171 may be formed at the suction inlet 110. Further, as described above, the separate flow path 170 may be installed in the casing main body 140. As illustrated in FIG. 3, the flow space 141 in which the flow path 170 sits may be formed in the casing main body 140.

The discharge outlet 120 may be formed at the upper casing 150. In this embodiment, the flow space 141 formed in the casing main body 140 may have a shape open upward, and the upper casing 150 may be coupled to the casing main body 140 from an upper side of the casing main body 140 to shield the flow space 141. Accordingly, after removing the upper casing 150 from the casing main body 140, a user may remove the flow path 170 sitting in the flow space 141, so that washing of the flow path 170 may be performed.

The upper casing 150 may be coupled to the casing main body 140 such that the upper casing 150 covers a side surface of the casing main body 140. That is, the upper casing 150 may form a side outer surface of the head main body 130.

The lower casing 160 according to this embodiment may be coupled to the casing main body 140 from a lower side of the casing main body 140. The lower casing 160 according to an embodiment may have a plate shape.

A through hole (not shown) may be formed vertically through the lower casing 160 such that the through hole is located at a position corresponding to the suction inlet 110. Further, a pre-filter 514 may be installed in the through hole formed in the lower casing 160. The pre-filter 514 may filter dust or foreign matter having a relatively large size, for example, introduced into the suction inlet 110.

As illustrated in FIGS. 3 and 4, the discharge outlet 120 according to an embodiment may further include a fan housing 121. The fan housing 121 according to an embodiment may protrude upward from an upper flat surface of the head main body 130. The upper casing 150 may constitute the upper flat surface of the head main body 130, and the fan housing 121 may be formed by protruding upward from an upper flat surface of the upper casing 150.

In this embodiment, the fan housing 121 may have a cylindrical shape open in the vertical direction, and the discharge fan 410 may be received in the fan housing 121. More specifically, in a state in which the fan housing 121 is configured to protrude upward from the upper casing 150 of the head main body 130, the fan housing 121 may be configured to receive the discharge fan 410 therein, whereby as illustrated in FIG. 3, even if the discharge fan 410 and the fan motor 420 are arranged vertically in the head main body 130, an entire thickness of the head main body 130 may be slimmed.

A discharge grill 122 may be removably coupled to an upper opening of the fan housing 121 according to an embodiment and may cover the upper opening of the fan housing 121. Accordingly, the discharge grill 122 may prevent accidents which may occur during rotation of the discharge fan 410 and enable oil vapor to be discharged to the upper side of the discharge fan 410.

Figure 6:
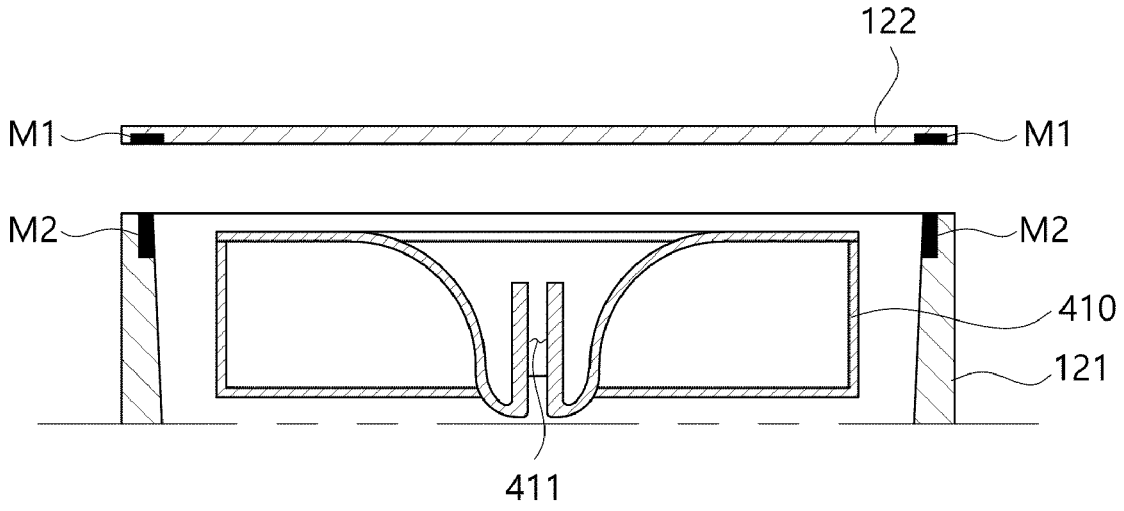
FIG. 6 is a cross-sectional view illustrating a discharge outlet according to an embodiment.

In this embodiment, the discharge fan 410 may be detachably coupled to the fan housing 121 by magnetic force. Referring to FIG. 6, at least one first magnetic member or magnet M1 may be installed at an edge of the discharge grill 122, and a second magnetic member or magnet M2 corresponding to the first magnetic member M1 may be installed at an upper edge of the fan housing 121, whereby the discharge grill 122 may be removably coupled to the upper portion of the fan housing 121. Both the first magnetic member M1 and the second magnetic member M2 may have a magnetic force, or only one magnetic member may have a magnetic force.

As another example, the discharge grill 122 may be coupled to the fan housing 121 in a forcible fitting manner, or the discharge grill 122 may be hooked to the fan housing 121 by rotating the discharge grill 122. Accordingly, the discharge grill 122 may be detachably coupled to the fan housing 121 in various manners.

Figure 7:
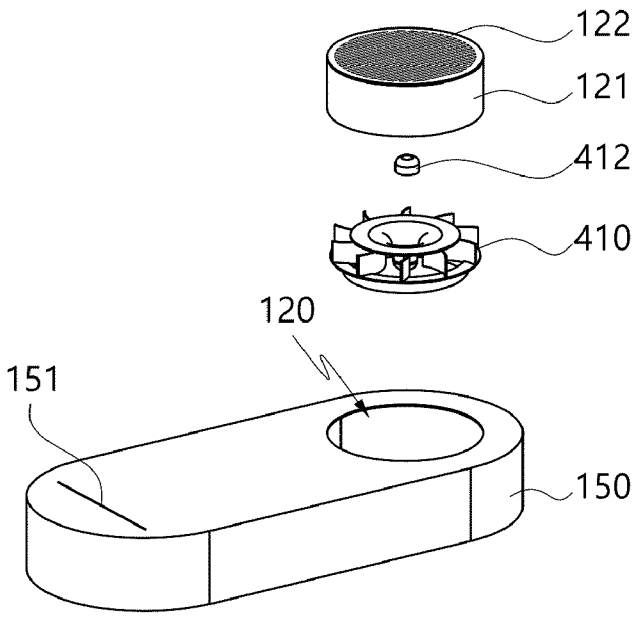
FIG. 7 is a partial exploded perspective view illustrating a discharge outlet according to another embodiment.

In the embodiment illustrated in FIG. 4, the fan housing 121 is integrated with the upper casing 150 of the head main body 130, so that the fan housing 121 is configured such that the fan housing 121 cannot be removed from the upper casing 150 of the head main body 130. As another example, as illustrated in FIG. 7, the fan housing 121 may be detachably coupled to the upper casing 150 of the head main body 130.

Figure 8:
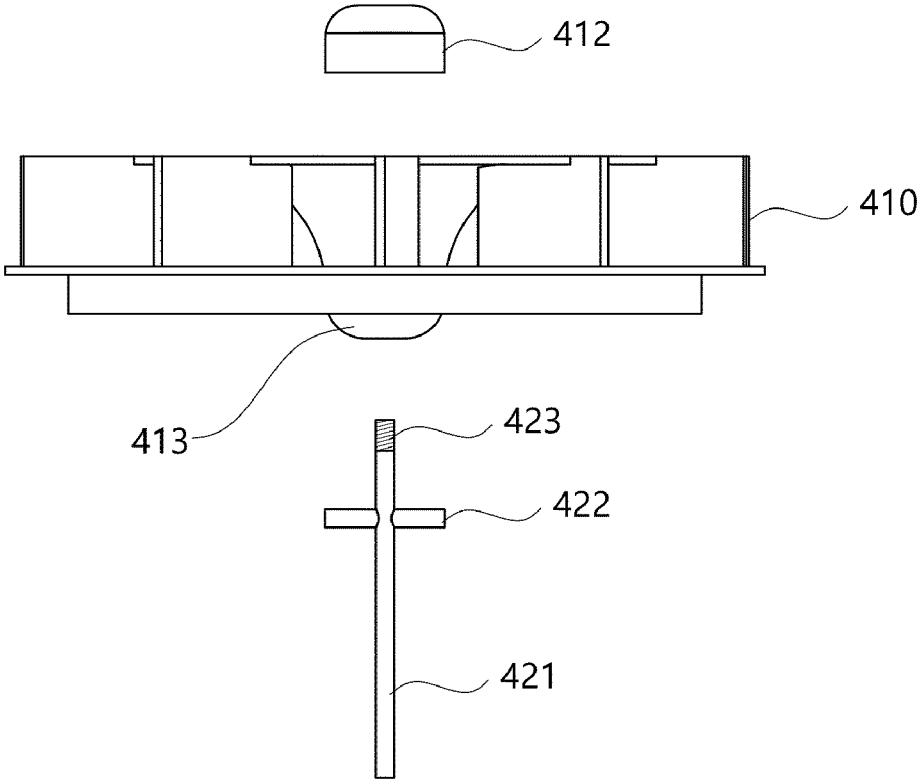
FIGS. 8 and 9 are views illustrating a coupling relationship between a discharge fan and a fan motor according to an embodiment.
Figure 9:
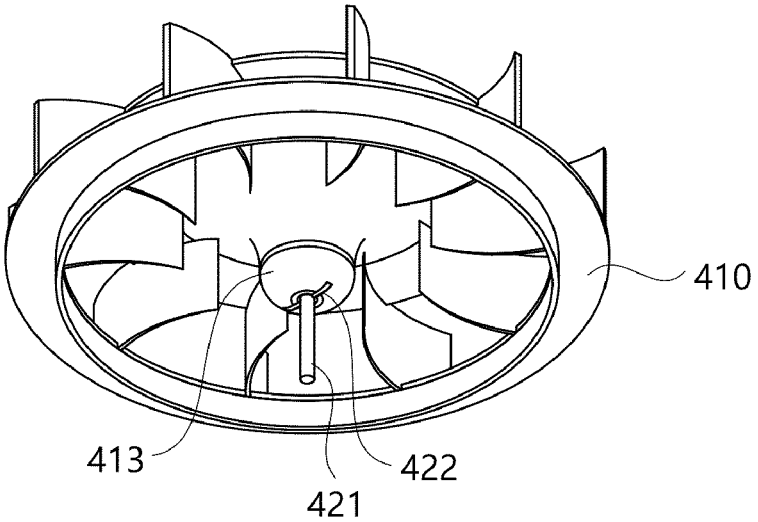

FIGS. 8 and 9 are views illustrating a coupling relationship between a discharge fan and a fan motor according to an embodiment. Referring to FIGS. 3, 8, and 9, fan motor 420 according to an embodiment may include a fan shaft 421. The fan shaft 421 may extend from the fan motor 420 toward the discharge fan 410 and may transmit a rotational force of the fan motor 420 to the discharge fan 410. As illustrated in FIG. 8, threads 423 may be formed at an outer circumferential surface of an end portion or end of the fan shaft 421 of the discharge fan 410.

The discharge fan 410 according to this embodiment may include a shaft through hole 411 (see FIG. 6) formed vertically therethrough. When connecting the discharge fan 410 with the fan motor 420, the end portion of the fan shaft 421 may pass through the shaft through hole 411 such that the discharge fan 410 and the fan shaft 421 are coupled to each other. In this case, the end portion of the fan shaft 421, that is, the end portion on which the threads 423 are formed may be exposed to the upper side of the discharge fan 410.

The discharge fan 410 according to this embodiment may further include a fan nut 412. The fan nut 412 may be engaged with the threads 423 formed at the end portion of the fan shaft 421 passing through the shaft through hole 411 such that the discharge fan 410 is held to the fan shaft 421. According to this configuration, after the discharge grill 122 is removed from the fan housing 121, the fan nut 412 may be unscrewed from the fan shaft 421, so that the discharge fan 410 may be removed from the fan shaft 421.

A fan holding portion or holder 413 may be formed at a lower portion of the discharge fan 410. Further, the fan shaft 421 may further include a shaft holding portion or holder 422 held in the fan holding portion 413.

The shaft holding portion 422 according to an embodiment may protrude radially outward from an outer surface of the fan shaft 421 and may be held in the fan holding portion 413 when the fan shaft 421 passes through the shaft through hole 411. As illustrated in FIGS. 8 and 9, the shaft holding portion 422 may be provided in the shape of a bar that protrudes radially outward from the fan shaft 421, and the fan holding portion 413 may have a slot formed therein such that the bar-shaped shaft holding portion 422 may be inserted into the slot. Accordingly, when the fan shaft 421 is rotated by rotation of the fan motor 420, the shaft holding portion 422 held in the fan holding portion 413 may rotate the discharge fan 410.

Figure 10:
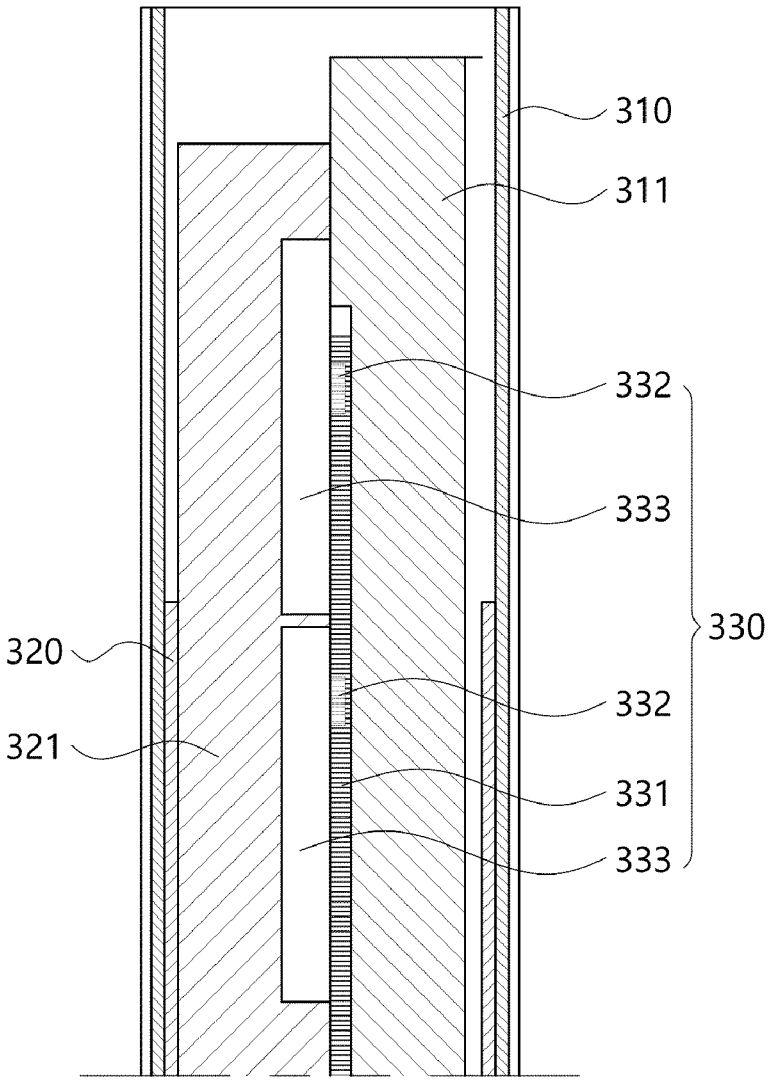
FIGS. 10, 11A, and 11B are views illustrating a height adjustment structure of a column according to an embodiment.
Figure 11A:
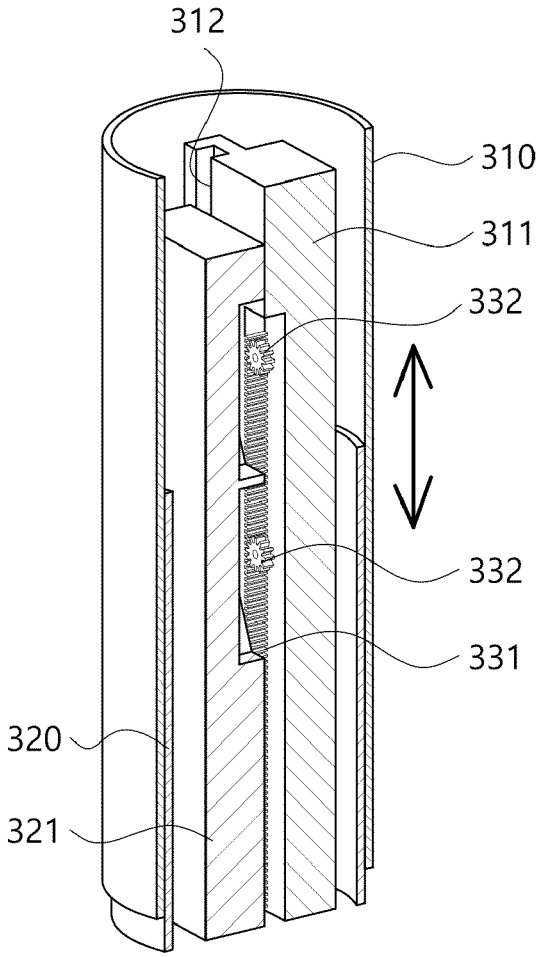
Figure 11B:
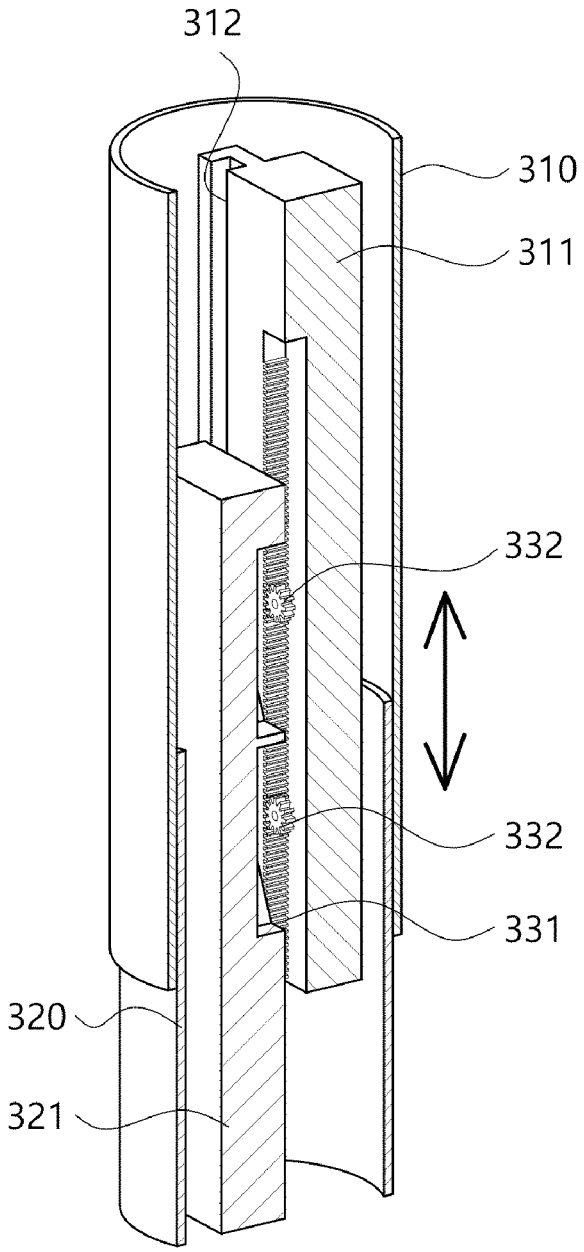

The column 300 according to an embodiment may be provided such that a distance between the head 100 and the base 200, that is, a height of the head 100 is adjustable. FIGS. 10, 11A, and 11B are views illustrating a height adjustment structure of column 300 according to an embodiment.

Referring to FIGS. 10, 11A, and 11B, the column 300 according to an embodiment may include a first column 310, a second column 320, and a height adjustment unit 330. The first column 310 may be coupled to the head 100 at a first side thereof. The first column 310 is illustrated as having a cylindrical shape; however, embodiments are not limited thereto and the first column may be provided, for example, in the shape of a polygonal pillar, such as a container having a square cross section.

The second column 320 may be coupled to the base 200 at a first side thereof. The shape of the second column 320 may correspond to the shape of the first column 310, and thus, may have a cylindrical shape. Alternatively, the second column 320 may have a shape different from the cylindrical shape corresponding to the first column 310.

A second side of the second column 320, that is, an upper area of the second column 320 may be inserted through a lower portion of the first column 310, which is a second side of the first column 310. Accordingly, a height of the head 100 may be adjusted according to a height of the second column 320 inserted into the lower portion of the first column 310. The height adjustment unit 330 according to an embodiment may vertically move the first column 310 relative to the second column 320 such that the height of the head 100 is adjustable.

In this embodiment, as illustrated in FIGS. 10, 11A, and 11B, the height adjustment unit 330 may include a rack member or rack 331, a pinion member or pinion 332, and a damper 333. The rack 331 according to an embodiment may be installed at a first side of one of the first column 310 or the second column 320. In this embodiment, as illustrated in FIGS. 11A and 11B, the rack 331 is installed in the first column 310.

The rack member 331 may extend along the vertical direction of a first guide member or guide 311 coupled to an inner surface of the first column 310. The pinion 332 according to an embodiment may rotate in engagement with the rack 331. The pinion 332 may be coupled to the second column 320 (or the first column 310, the same hereinafter) through the damper 333, so that the pinion 332 may vertically move together with the second column 320.

The damper 333 according to an embodiment may be installed at a second side of one of the first column 310 and the second column 320. That is, in a case in which the rack 331 is installed at the first column 310, the damper 333 may be installed at the second column 320, and in a case in which the rack 331 is installed at the second column 320, the damper 333 may be installed at the first column 310. In this embodiment, the damper 333 is installed at the second column 320. Further, in this embodiment, the damper 333 may be installed at a second guide member or guide 321 coupled to an inner surface of the second column 320.

The damper 333 may be connected to a rotational shaft of the pinion 332 and may vertically move the first column 310 when the pinion 332 rotates in engagement with the rack 331. In this case, the damper 333 provides a load to the first column 310 such that a vertical position of the first column 310 is maintained, so that a height of the head 100 may be adjusted to a predetermined height.

Accordingly, when adjusting the height of the head 100, a user may vertically move the head 100. The head 100 may vertically move while the rack 331 operates in engagement with the pinion 332. Further, when a user stops the vertical movement of the head 100 at a desired height, the vertical movement of the head 100 may stop at the desired height according to the load of the damper 333, so that the height of the head 100 may be adjusted to the desired height.

In this embodiment, as illustrated in FIGS. 11A and 11B, a guide groove 312 may be formed at the first guide 311 along a vertical direction thereof. Further, a guide rib (not shown) may be formed at the second guide 321 such that the vertical movement of the head 100 is guided with the guide rib inserted into the guide groove 312. Accordingly, vertical relative movement of the first guide 311 to the second guide 321 may be stable, so that the vertical movement of the first column 310 may be stably performed.

As described above, in the portable hood 10 according to an embodiment, the head 100 rotates horizontally relative to the column 300. The portable hood 10 according to an embodiment may further include a rotation unit 700 that couples the column 300 and the base 200 to each other such that the column 300 rotates relative to the base 200.

Figure 12:
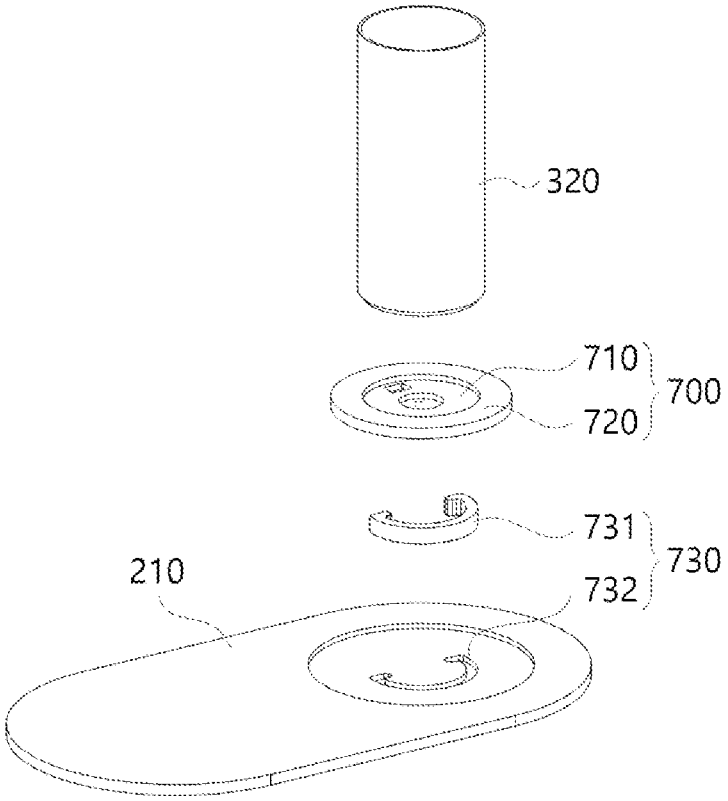
FIGS. 12 and 13 are views of a rotation unit according to an embodiment.
Figure 13:
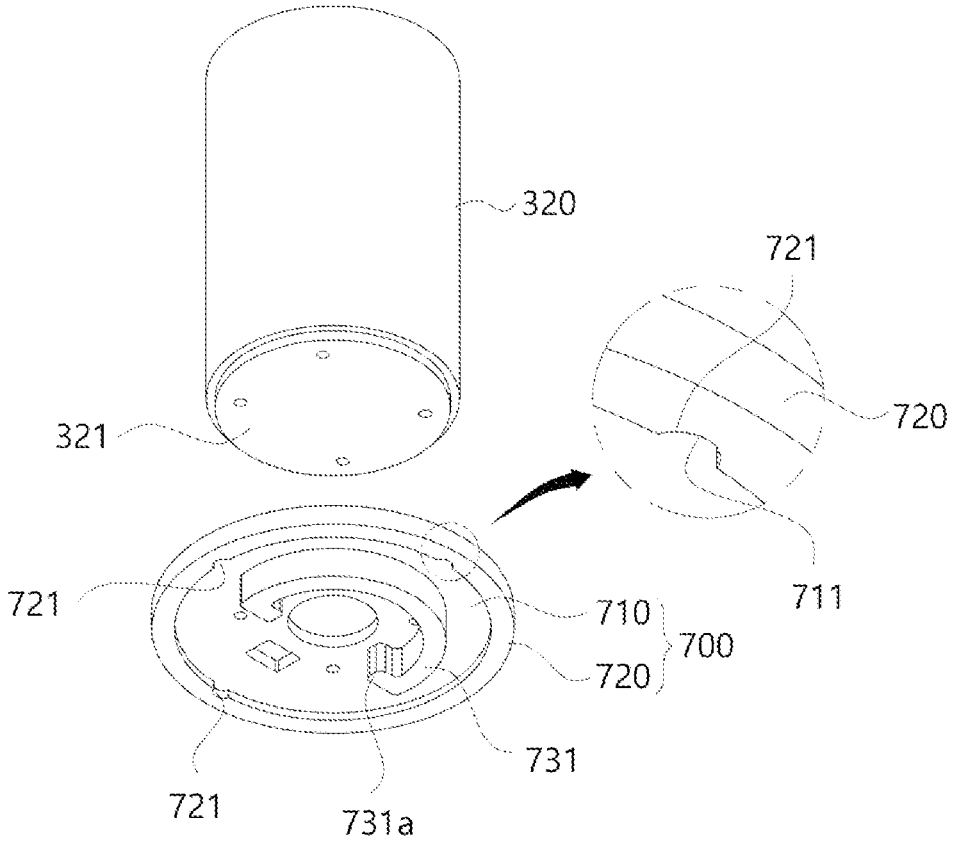

FIGS. 12 and 13 are views of a rotation unit according to an embodiment. Referring to FIGS. 12 and 13, rotation unit 700 according to an embodiment may include a first rotating member 710 and a second rotating member 720.

The first rotating member 710 may be installed at a lower portion of the column 300. In this embodiment, the column 300 includes the first column 310 and the second column 320, and the first rotating member 710 is installed at a lower portion of the second column 320.

The second rotating member 720 may be installed at the base 200. The second rotating member 720 may support the first rotating member 710 such that the first rotating member 710 is rotatable to rotate the column 300.

In this embodiment, the first rotating member 710 has a shape of a circular plate. Further, the second rotating member 720 may have a shape of a circular ring to support the first rotating member 710 such that the second rotating member 720 is rotatable along an inner circumference of the first rotating member 710. Accordingly, the first rotating member 710 may stably rotate in the second rotating member 720 having the shape of a circular ring.

A holding protrusion 711 may be formed on an outer circumference of the first rotating member 710 protruding outward in a radial direction therefrom. Further, a plurality of holding recesses 721 may be formed at predetermined angle intervals at an inner circumference of the second rotating member 720. When the first rotating member 710 rotates, the holding protrusion 711 may be inserted and held in the holding recess 721 formed at a predetermined angle, and a user may recognize a predetermined angular rotation and the holding of the holding protrusion 711 may be maintained at the associated angle in a state in which an external force is not applied.

For example, three holding recesses 721 may be formed at 90° intervals. The three holding recesses 721 may be formed at positions at which the base 200 and the head 100 are located side by side in a vertical direction, as illustrated in FIG. 2A, and at positions of the head 100 rotating 90° to the left and to the right relative to the base 200, as illustrated in FIGS. 2B and 2C. Accordingly, the holding recess 721 may be formed at an angle with a relatively high frequency of use among rotational angles of the head 100 such that user convenience of the portable hood 10 is increased.

The rotation unit 700 according to an embodiment may further include a rotation control portion 730. For example, the rotation control portion 730 may control rotation of the first rotating member 710 such that the head 100 rotates only to a preset or predetermined angle from a position parallel to the base 200. For example, in this embodiment, as illustrated in FIGS. 2A, 2B, and 2C, the rotation control portion 730 may control the rotation of the first rotating member 710 such that the first rotating member 710 may rotate by 90° to each side, a maximum of 180°.

In this embodiment, the rotation control portion 730 may include a control member 731 coupled to the first rotating member 710, and a control groove 732 formed at the base 200. The control groove 732 may be formed at a flat surface of the base 200 such that the control groove 732 has a semicircular shape of 180°. A control protrusion 731*a* formed at the control member 731 may be held in the control groove 732 such that the control member 731 rotates only within the range of 180° while the control member 731 rotates with the control protrusion 731*a* inserted in the control groove 732.

According to this configuration, the head 100 may be configured to rotate 90° to each side, that is, only within a range of 180°, whereby twisting of a cable connected from the base 200 to the head 100, for example, a power cable or signal cable for rotation and control of the fan motor 420 may be minimized.

In addition, as illustrated in FIGS. 2A, 2B, and 2C, the portable hood 10 according to an embodiment may be used at various angles within a 180° rotational range and may cover any position at which the portable hood 10 is required to be used.

In the embodiment described above, the discharge fan 410 and the fan motor 420 of the portable hood 10 according to an embodiment are described as arranged vertically at the upper side of the column 300.

Figure 14:
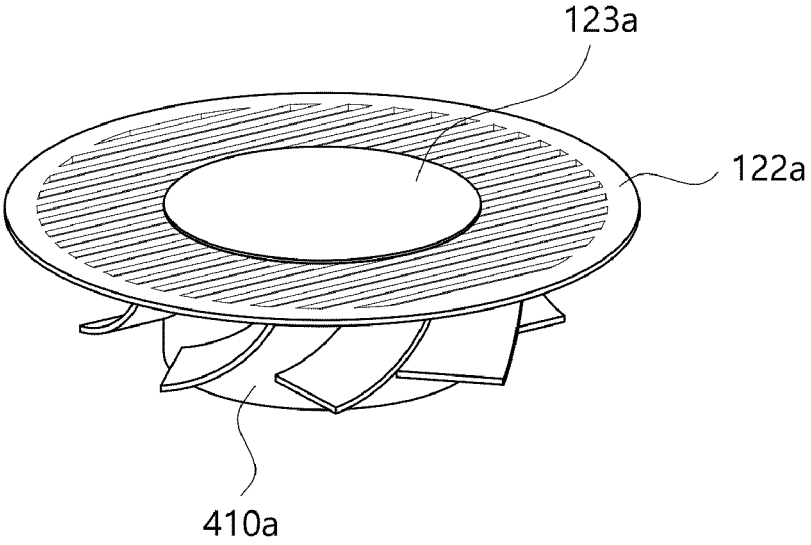
FIGS. 14 to 16 are views illustrating the discharge fan and the fan motor integrated with each other according to an embodiment.
Figure 15:
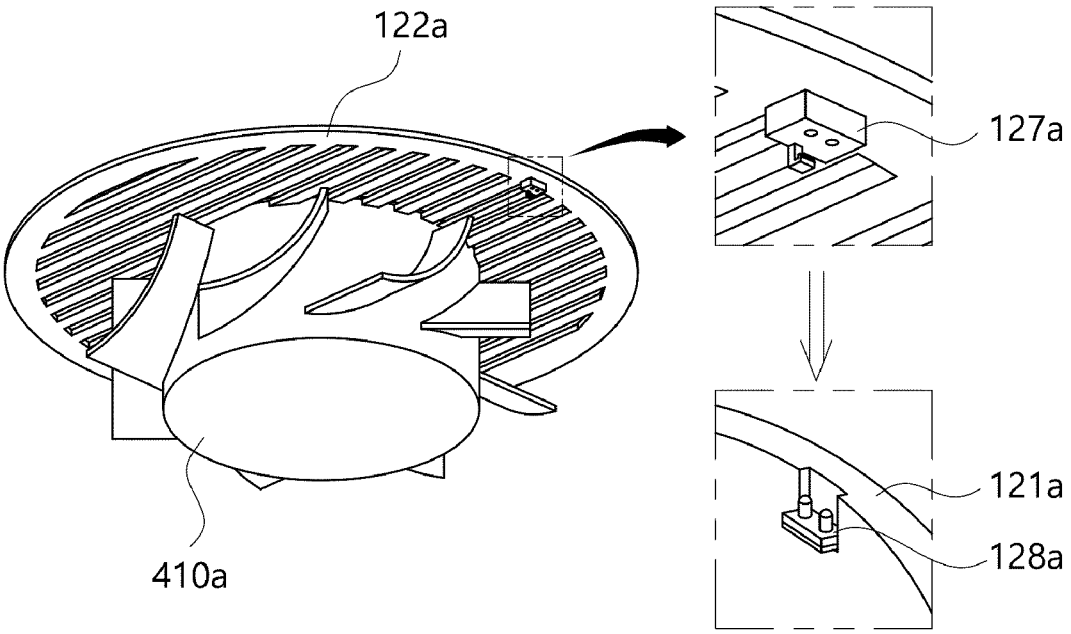
Figure 16:
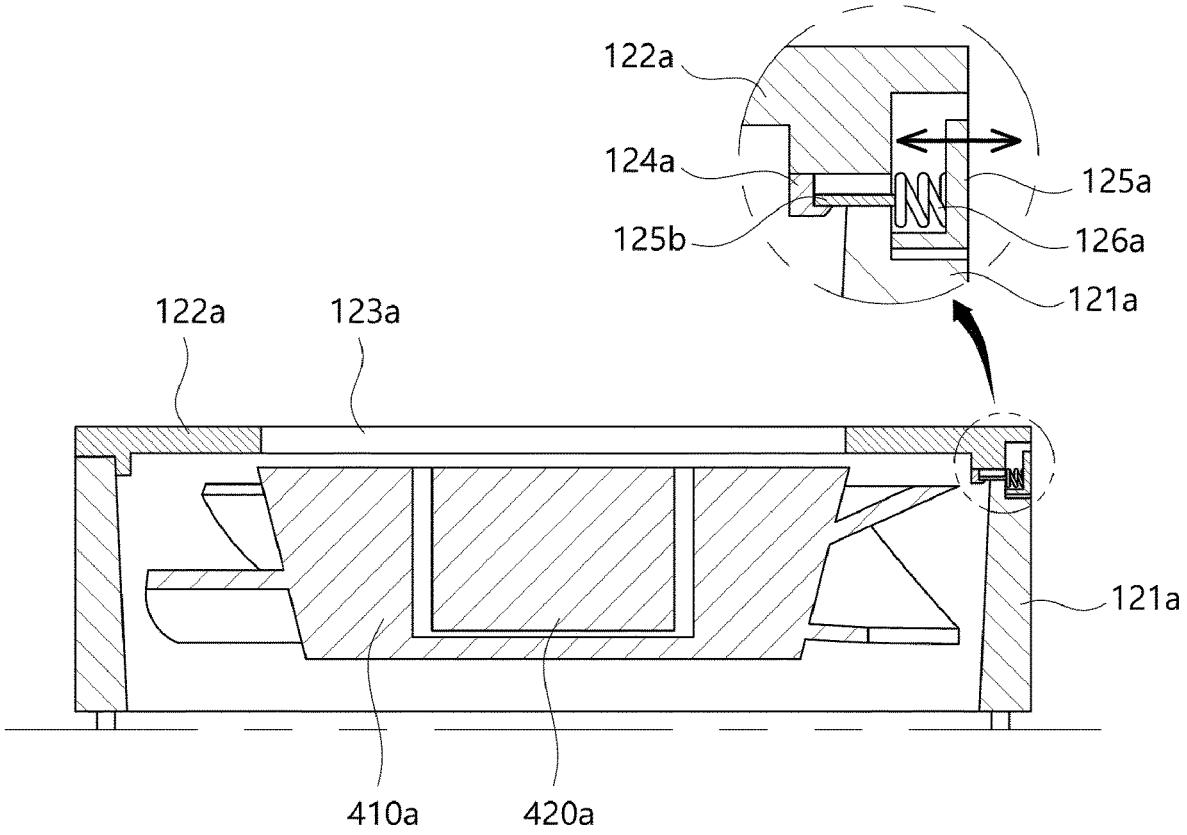

As another example, the discharge fan 410 and the fan motor 420 according to an embodiment may be integrated with each other and may be installed at the upper side of the column 300. FIGS. 14 to 16 are views illustrating the a discharge fan and a fan motor integrated with each other according to an embodiment.

Referring to FIGS. 14 to 16, discharge fan 410*a* may be installed in the discharge outlet 120, for example, inside of fan housing 121*a*. Further, fan motor 420*a* may be installed in the discharge fan 410*a* and may rotate the discharge fan 410*a*.

In addition, the discharge outlet 120 according to an embodiment may further include shaft connection member or connector 123*a*. The shaft connection member 123*a* may connect the rotational shaft of the discharge fan 410*a* to discharge grill 122*a* such that the discharge fan 410*a* rotates inside of the fan housing 121*a*. Accordingly, when removing the discharge grill 122*a* from the fan housing 121*a*, the discharge fan 410*a* and the fan motor 420 together may be removed from the fan housing 121*a* by the shaft connection member 123*a*.

According to this configuration, the discharge fan 410*a* and the fan motor 420 may be integrally received in the fan housing 121*a*, and as described above, a center of weight of the portable hood 10 according to an embodiment may be formed at the column 300, so tipping over of the portable hood 10 may be prevented.

In order to connect a power cable to the fan motor 420 installed inside of the discharge fan 410*a*, the portable hood 10 according to an embodiment may further include a first connector 127*a* and a second connector 128*a*. The first connector 127*a* may be installed at the discharge grill 122*a* and may be electrically connected to the fan motor 420. Further, the second connector 128*a* may be installed at the fan housing 121*a* such that the second connector 128*a* is located at a position corresponding to a position of the first connector 127*a*. When the discharge grill 122*a* is mounted to the fan housing 121*a*, the second connector 128*a* may be connected to the first connector 127*a* and may supply power to the fan motor 420. The second connector 128*a* may be electrically connected to a printed circuit board installed at the base 200 through the column 300, so that when the first connector 127*a* and the second connector 128*a* are connected to each other, power may be supplied to the fan motor 420.

As illustrated in FIG. 16, the discharge outlet 120 according to an embodiment may include a holding jaw 124*a*, a holding lever 125*a* and 125*b*, and an elastic member or spring 126*a*. The holding jaw 124*a* according to an embodiment may be installed at the discharge grill 122*a*. The holding jaw 124*a* may be inserted into the fan housing 121*a* when the discharge grill 122*a* is mounted to the fan housing 121*a*.

The holding lever 125*a* and 125*b* according to an embodiment may be installed at the fan housing 121*a* such that the holding lever 125*a* and 125*b* may be held in and released from the holding jaw 124*a*. Accordingly, in a state in which the holding lever 125*a* and 125*b* is held in the holding jaw 124*a*, the discharge grill 122*a* may be coupled to and held in the fan housing 121*a*, and when the holding lever 125*a* and 125*b* is released from the holding jaw 124*a*, the discharge grill 122*a* may be removed from the fan housing 121*a*.

The elastic member 126*a* according to an embodiment may elastically press the holding lever 125*a* and 125*b* in a direction in which the holding lever 125*a* and 125*b* is held in the holding jaw 124*a*. In this embodiment, the holding lever 125*a* and 125*b* may be located at an outer side of the fan housing 121*a* and may include a lever 125*a* which may be pulled by a user's hand and a holding portion 125*b* that extending to an inner side of the fan housing 121*a* from the lever 125*a* and held in and released from the holding jaw 124*a*. Further, the elastic member 126*a* may be provided as a tension spring and may pull the lever 125*a* in a direction in which the holding portion 125*b* is held in the holding jaw 124*a* such that the holding portion 125*b* is maintained to be held in the holding jaw 124*a*.

According to the above configuration, when a user pulls the lever 125*a*, an elastic force of the tension spring may be overcome, and the holding portion 125*b* may be removed from the holding jaw 124*a*, so that the discharge grill 122*a* may be removed from the fan housing 121*a*.

Figure 17:
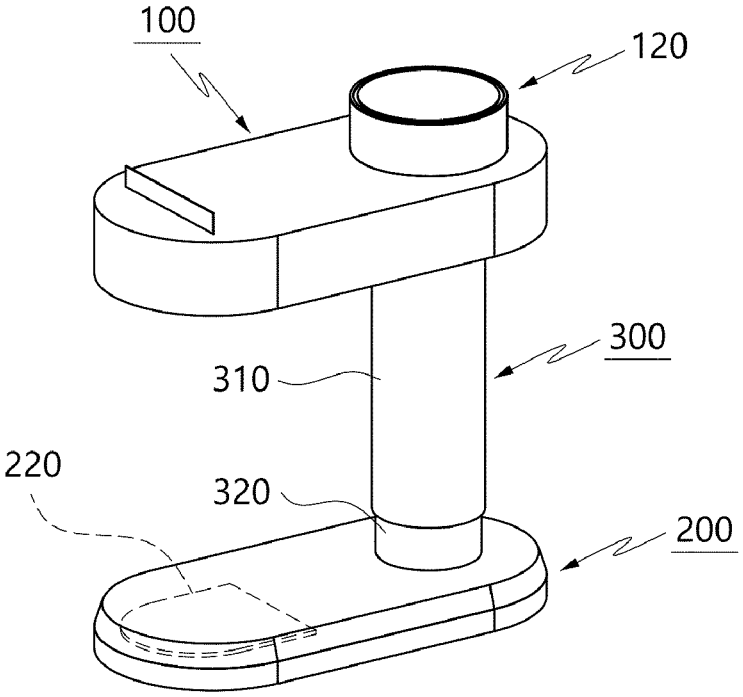
FIG. 17 is a perspective view illustrating an installed state of a weight plate of a portable hood according to another embodiment.

As illustrated in FIG. 17, base 200 according to another embodiment may include a weight plate 220. The weight plate 220 may be made of metal, for example, and may be provided in the base 200 such that the column 300 and the head 100 are prevented from tipping over.

As described above, the head 100 and the base 200 according to an embodiment may be coupled eccentrically to the column 300 in horizontal directions, and the head 100 may be horizontally rotatable. The weight plate 220 made of relatively heavy metal may be provided in the base 200, and thus, a center of weight of the portable hood 10 may be located at a lower side of the portable hood 10, so that the portable hood 10 according to this embodiment may be prevented from tipping over.

The portable hood 10 according to an embodiment may further include a battery module 800. The portable hood 10 may be provided with a power cable (not shown) to receive power and may have the battery module 800 installed therein to increase portability such that the battery module 800 supplies power required for operating the fan motor 420.

Figure 18A:
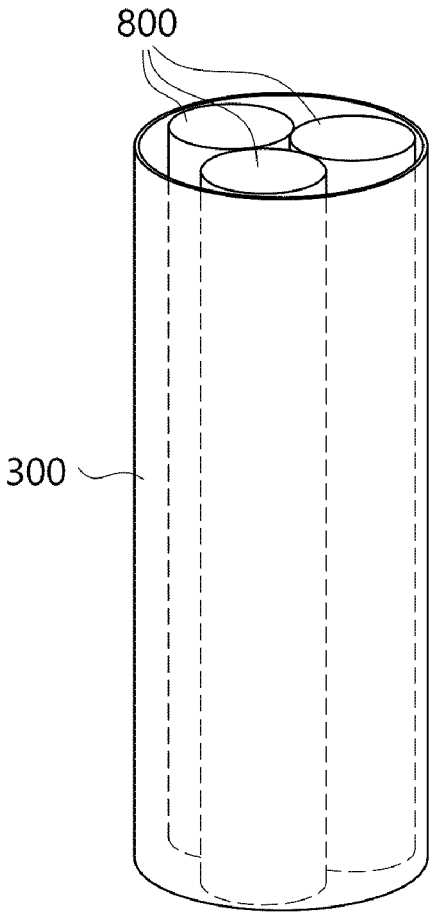
FIGS. 18A and 18B are views illustrating an installed state of a battery module of a portable hood according to still another embodiment.
Figure 18B:
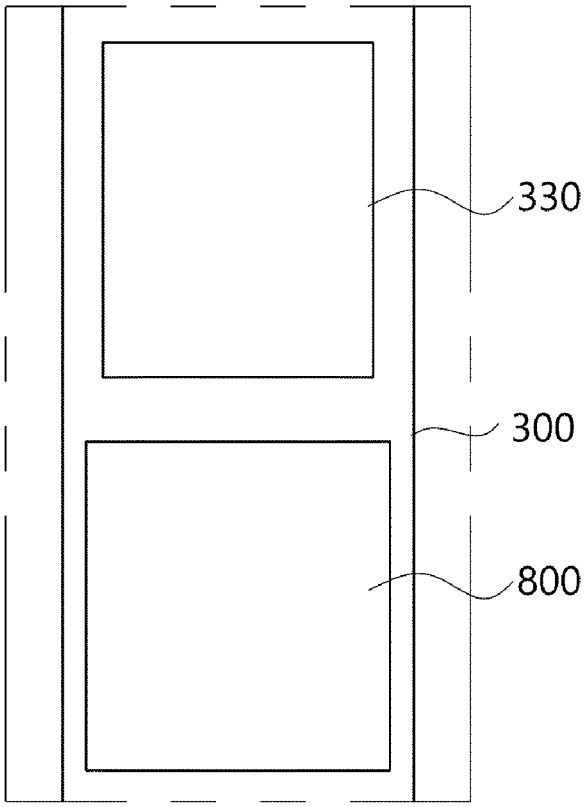

In still another embodiment, as illustrated in FIGS. 18A and 18B, the battery module 800 may be provided inside of the column 300. Accordingly, important components may be arranged in the column 300, and the center of weight of the portable hood 10 may be formed at the column 300, so that tipping over of the portable hood 10 may be prevented.

The battery module 800 may be arranged at a lower portion inside of the column 300. When the height adjustment unit 330 described above is installed in the column 300, as illustrated in FIG. 18B, the height adjustment unit 330 may be located at the upper side of the column 300, and the battery module 800 may be located at the lower portion of the column 300. Accordingly, height adjustment of the column 300 may be performed, and due to inclusion of the battery module 800 inside of the column, the portable hood 10 according to an embodiment may be more effectively prevented from tipping over.

In addition, in a case in which the battery module 800 includes a plurality of battery modules, as illustrated in FIG. 18A, the plurality of battery modules 800 may be horizontally arranged in parallel to each other in the column 300. Accordingly, the portable hood 10 may maintain a more stable standing state, so that the portable hood 10 may be prevented from tipping over.

Figure 19:
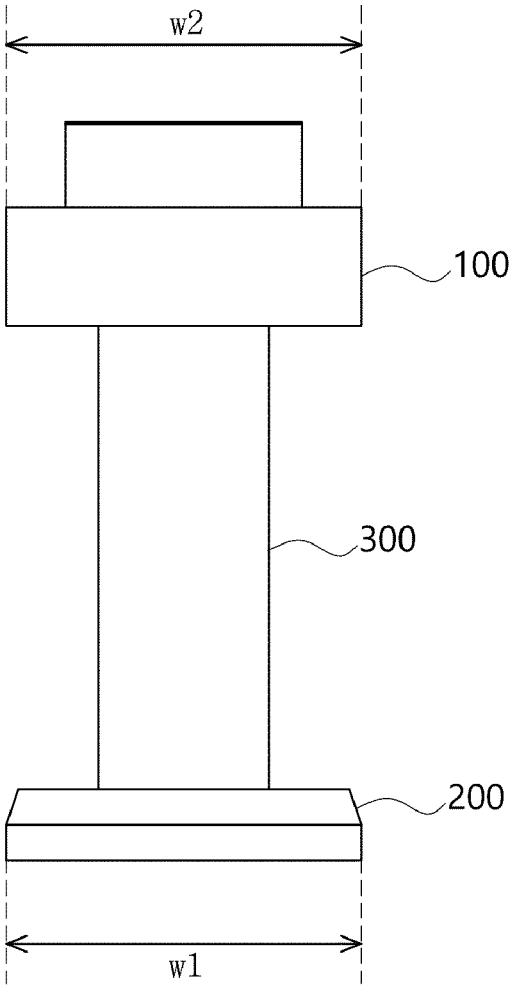
FIG. 19 is a front view of a portable hood according to an embodiment.

Further, in the portable hood 10 according to an embodiment, as illustrated in FIG. 19, a width w1 of the base unit 200 in a direction perpendicular to a direction toward the suction inlet 110 from the discharge outlet 120 eccentric from each other may be equal to or wider than a width w2 of the head 100. That is, in a short length direction of a horizontal cross-section of each of the base 200 and the head 100, the width w1 of the base 200 may be equal to or wider than the width w2 of the head 100. Accordingly, a more stable standing of the portable hood 10 may be ensured, so that the portable hood 10 may be effectively prevented from tipping over.

Figure 20:
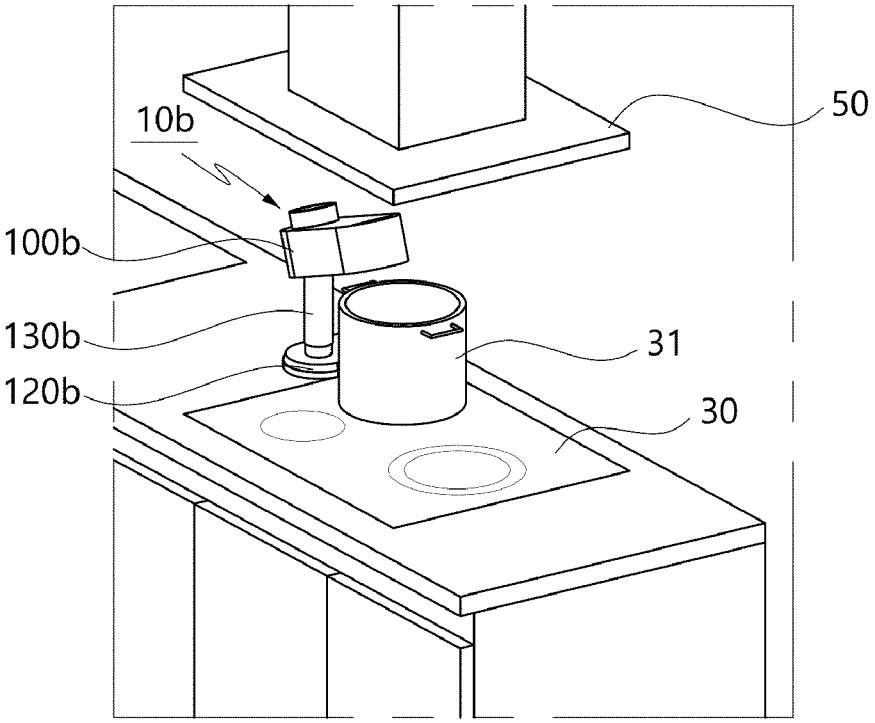
FIG. 20 is a view illustrating a state of use of a portable hood according to still another embodiment.

In the above-described embodiments, the head 100 according to an embodiment may be configured to rotate in a horizontal direction and may be configured to be adjustable in height. For another example, as illustrated in FIG. 20, head 100 according to still another embodiment may be coupled to the column 300 such that the head 100 may be adjusted by an angle in a vertical direction. Accordingly, the head 100 may perform adjustment of an air-introduction angle in addition to height adjustment and may effectively respond even to a cooking utensil located at a height beyond a range of the height adjustment of the head 100.

The portable hood 10 according to an embodiment may further include a filter unit 500 as illustrated in FIG. 3. The filter unit 500 according to an embodiment may be installed in the suction inlet 110. In this embodiment, the filter unit 500 may include at least one purification filter 512, 513, or 514 that purifies air introduced into the suction inlet 110. For example, the purification filter 512, 513, 514 may include at least one of a deodorization filter 512 or an oil mist filter 513. In this embodiment, the deodorization filter 512 and the oil mist filter 513 are installed in the suction inlet 110. As described above, pre-filter 514 installed in the through hole of the lower casing 160 may be included as a component of the purification filter 512, 513, or 514.

In this embodiment, as the oil mist filter 513, a fiber filter, such as a non-woven fabric, may be applied. Further, an aluminum mesh filter may be used as pre-filter 514, and a filter made of corrugated activated carbon may be used as deodorization filter 512. The example of each of the deodorization filter 512, the oil mist filter 513, and the pre-filter 514 described above is used in this embodiment; however, embodiments are not limited thereto, and filters made of other materials may be utilized.

In this embodiment, as illustrated in FIG. 4, after the upper casing 150 is removed from the casing main body 140, the deodorization filter 512 may be inserted from the upper side of the suction inlet 110 of the casing main body 140 and may be installed in the suction inlet 110. Accordingly, after the upper casing 150 is removed from the casing main body 140, replacement of the deodorization filter 512 may be performed.

The oil mist filter 513 according to an embodiment may be a roll filter. The portable hood 10 according to an embodiment may include roll filter unit 610 such that the oil mist filter 513 may be discharged past or through the suction inlet 110 to the outside of the head 100.

FIGS. 21 to 27 are views illustrating a roll filter unit according to an embodiment. Referring to FIGS. 21 to 27, roll filter unit 600 according to an embodiment may include a filter roll 610 and filter transportation unit 620.

Figure 21:
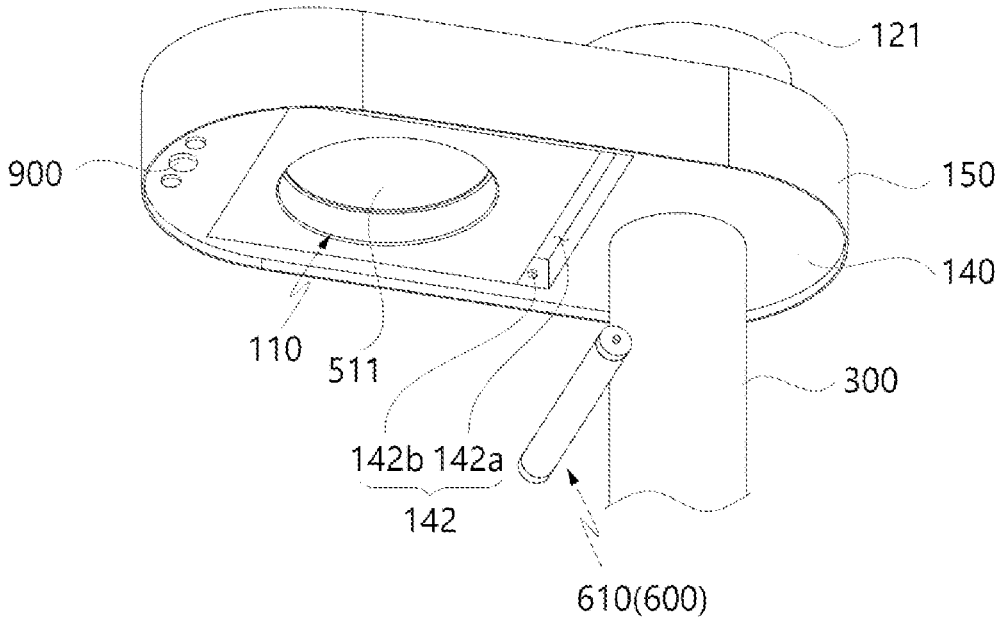
FIGS. 21 to 27 are views illustrating a roll filter unit according to an embodiment.

The oil mist filter 513 may be wound on the filter roll 610. The filter roll 610 may be rotatably installed at the head 100 with the oil mist filter 513 wound on the filter roll 610. In this embodiment, as illustrated in FIG. 21, the filter roll 610 is removably installed at or in roll mounting portion 142 formed at a lower portion of the casing main body 140 of the head main body 130.

The roll mounting portion 142 according to this embodiment may include a roll receiving portion 142*a* and a shaft coupling portion 142*b*. The roll receiving portion 142*a* may be open downward at a lower surface of the casing main body 140 such that the filter roll 610 may be inserted into the roll receiving portion 142*a* from a lower side of the casing main body 140. Further, the shaft coupling portion 142*b* may be formed at each of opposite inner wall surfaces of the roll receiving portion 142*a*, so roll coupling kit 612 described hereinafter of the filter roll 610 may be coupled to the shaft coupling portion 142*b*.

Figure 22:
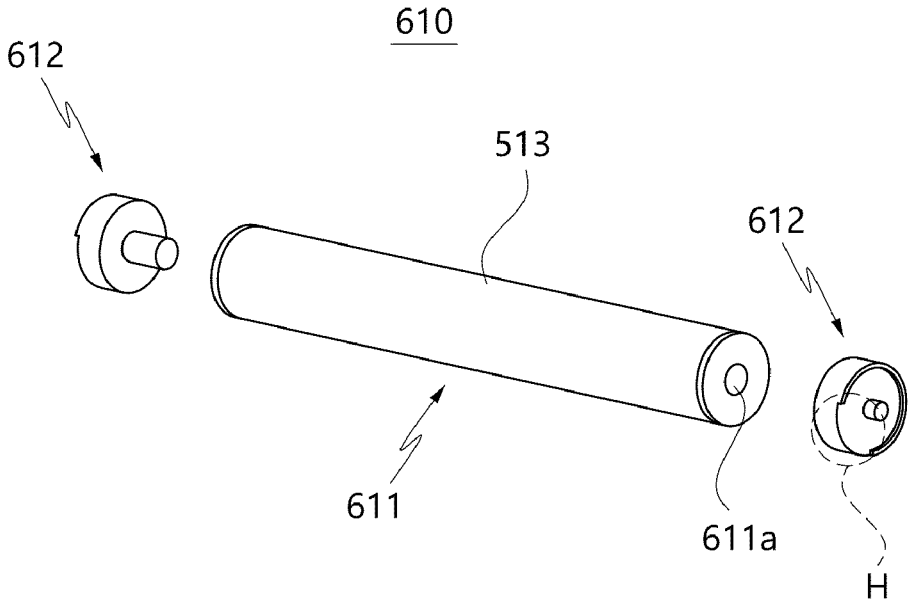
Figure 23A:
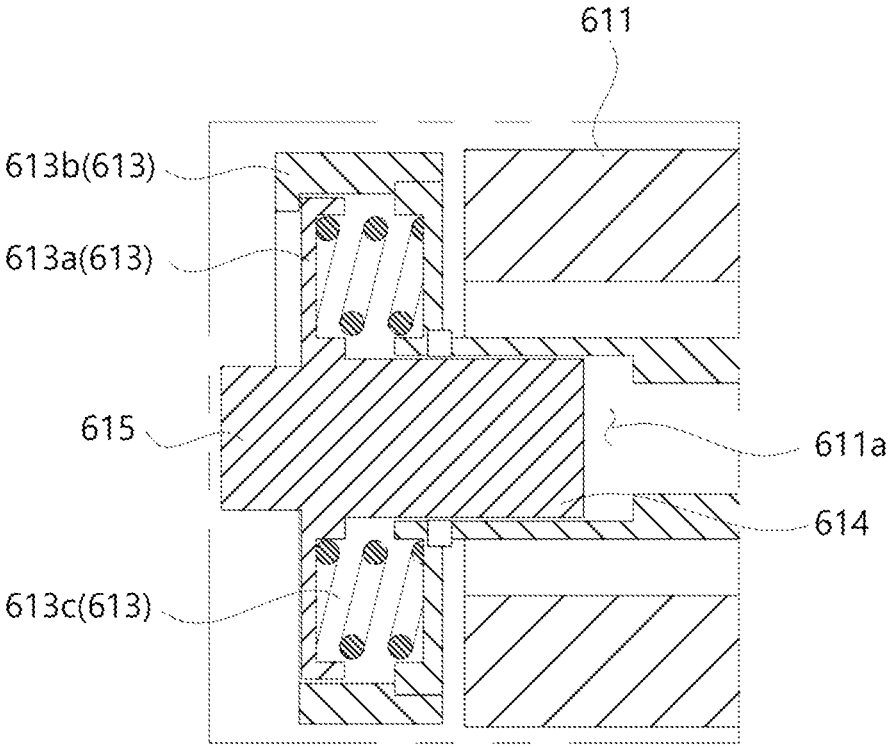
Figure 23B:
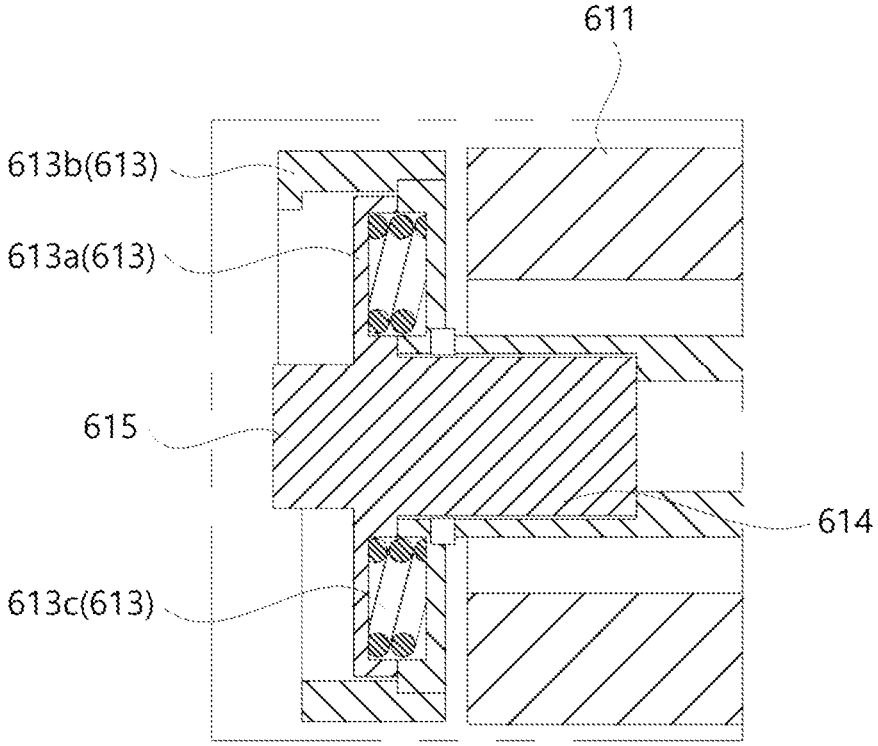

As illustrated in FIGS. 22, 23A, and 23B, the filter roll 610 according to this embodiment may include a filter drum 611 and a pair of roll coupling kits 612. The filter drum 611 may have a cylindrical shape, and the oil mist filter 513 may be wound on the filter drum 611 along an outer circumferential surface thereof.

The pair of roll coupling kits 612 may be installed at opposite sides of the filter drum 611, respectively. The pair of roll coupling kits 612 may support the filter drum 611 such that the filter drum 611 is rotatable, and when the filter roll 610 is installed in the roll mounting portion 142, the filter roll 610 may be removably coupled to each of the shaft coupling portions 142*b*.

In this embodiment, as illustrated in FIGS. 23A and 23B, roll coupling kit 612 may include a kit body 613, a first shaft protrusion 614, and a second shaft protrusion 615. The first shaft protrusion 614 may be rotatably coupled to a side surface of the filter drum 611 by protruding from a first side surface of the kit body 613. A protrusion insertion hole 611*a* may be formed in the side surface of the filter drum 611 such that the first shaft protrusion 614 may be rotatably inserted into the protrusion insertion hole 611*a*.

The second shaft protrusion 615 may be inserted into the shaft coupling portion 142*b* of the roll mounting portion 142 by protruding from a second side surface of the kit body 613. In this embodiment, when the second shaft protrusion 615 is coupled to the shaft coupling portion 142*b*, the second shaft protrusion 615 may be pressed in a direction of the second shaft protrusion 615 inserted into the shaft coupling portion 142*b*.

In this embodiment, as illustrated in FIGS. 23A and 23B, the kit body 613 according to an embodiment may include a first kit member 613*a*, a second kit member 613*b*, and a press member or spring 613*c*. The second shaft protrusion 615 may be provided at the first kit member 613*a* and may be coupled to the first kit member 613*a* such that the second shaft protrusion 615 moves in a direction of a rotational axis of the filter drum 611. The first shaft protrusion 614 and the second shaft protrusion 615 may be integrated with flat surfaces of opposite sides of the second kit member 613*b*, respectively.

The press member 613*c* may be installed between the first kit member 613*a* and the second kit member 613*b*. Further, the press member 613*c* may press the second kit member 613*b* in a direction in which the second shaft protrusion 615 is inserted into the shaft coupling portion 142*b*. In this embodiment, the press member 613*c* may be provided as a compression spring.

With the above configuration, when installing the filter roll 610 in the roll mounting portion 142, a user may insert the filter roll 610 into the roll receiving portion 142*a*. In this state, the user may push the second kit member 613*b* at a second side in a direction toward the first kit member 613*a* at the second side after inserting the second shaft protrusion 615 at a first side into the shaft coupling portion 142*b* at the first side such that the second shaft protrusion 615 at the second side is inserted into the shaft coupling portion 142*b* at the second side.

A coupling force of the second shaft protrusion 615 to the shaft coupling portion 142*b* and a coupling force of the first shaft protrusion 614 to the protrusion insertion hole 611*a* may be maintained constant by an elastic force of the press member 613*c*. Accordingly, when the filter transportation unit 620 moves the oil mist filter 513 wound on the filter roll 610, the filter transportation unit 620 may hold the oil mist filter 513 with tension and may prevent the oil mist filter 513 from being easily unwound.

In this embodiment, a cut portion H may be formed by cutting a portion of an edge of the first kit member 613*a* directed toward the shaft coupling portion 142*b* and may provide a space into which a user may insert a finger to push the second kit member 613*b*.

As illustrated in FIG. 3, the filter transportation unit 620 may be installed in the head 100 such that the filter transportation unit 620 is located at a side opposite to the filter roll 610 with the suction inlet 110 located between the filter transportation unit 620 and the filter roll 610. In this embodiment, the filter roll 610 may be installed inside of the casing main body 140 of the head main body 130.

With the suction inlet 110 placed between the filter roll 610 and the filter transportation unit 620, the filter roll 610 and the filter transportation unit 620 may be installed at opposite sides, respectively, in the eccentric direction of the suction inlet 110 and the discharge outlet 120. In this case, with the suction inlet 110 located between the filter transportation unit 620 and the filter roll 610, the filter roll 610 may be installed at a side of the discharge outlet 120 and at a side opposite to the filter transportation unit 620.

The filter transportation unit 620 according to an embodiment may discharge the oil mist filter 513 extending past the suction inlet 110 from the filter roll 610 to the outside of the head 100. For example, the filter transportation unit 620 may discharge the oil mist filter 513 to the upper side of the head 100.

Figure 24:
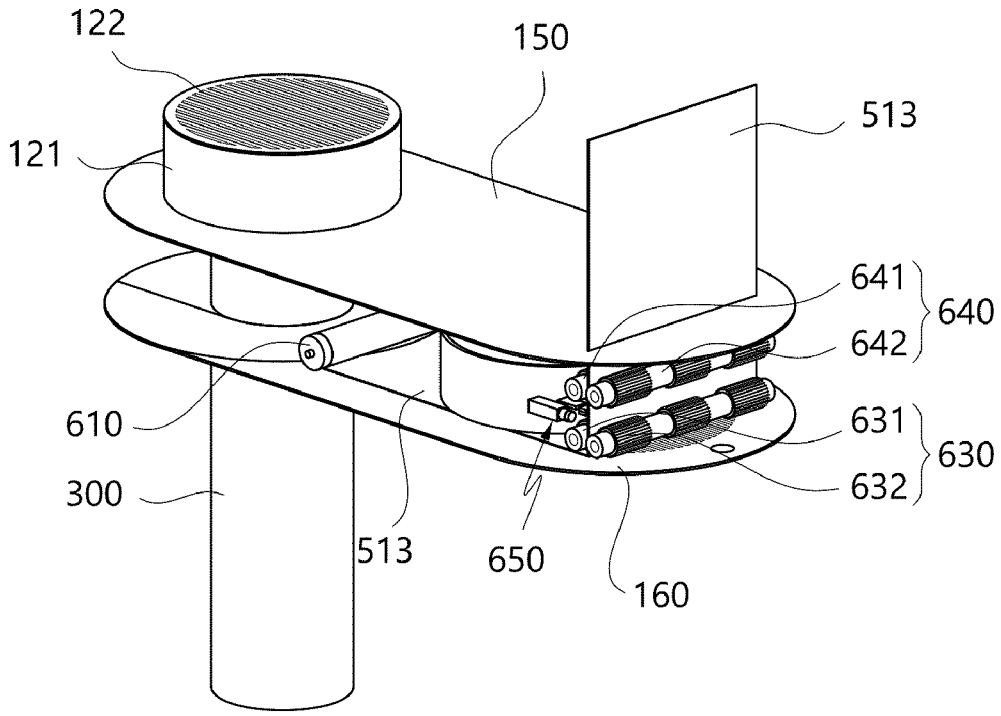

When described with reference to FIGS. 3, 24, and 25, the filter transportation unit 620 according to an embodiment may include a first roller unit 630 and a second roller unit 640. The first roller unit 630 and the second roller unit 640 may be installed in the casing main body 140 vertically spaced apart from each other and may discharge the oil mist filter 513 to the upper side of the head 100.

For example, the first roller unit 630 and the second roller unit 640 according to an embodiment may include a first moving roller 631 and a second moving roller 632, and a first moving roller 641 and a second moving roller 642, respectively. The first moving rollers 631 and 641 and the second moving rollers 632 and 642 may rotate by facing each other in the horizontal direction with the oil mist filter 513 located therebetween, so that the oil mist filter 513 may be moved upward. In this embodiment, corrugation in the shape of gear teeth may be formed on an outer circumferential surface of each of the first moving roller 631 or 641 and the second moving roller 632 or 642 such that the oil mist filter 513 may be efficiently moved.

In this embodiment, for example, the filter transportation unit 620 may further include a cutting unit 650. For example, the cutting unit 650 may be located between the first roller unit 630 and the second roller unit 640 and may cut the purification filter 511, 512, 513, or 514 in a transverse direction.

Accordingly, when the filter transportation unit 620 moves the oil mist filter 513 after the portable hood 10 according to an embodiment is used for a predetermined period of time, a new area of the oil mist filter 513 wound on the filter roll 610 may be moved to the suction inlet 110, and an area of the oil mist filter 513 used earlier may be moved outside of the head 100 along the filter transportation unit 620.

In this case, when the cutting unit 650 transversely cuts the oil mist filter 513 at a position located between the first roller unit 630 and the second roller unit 640, a user may pull a portion of the oil mist filter 513 exposed to the upper side of the head 100 and may remove the exposed portion. Next, when the filter transportation unit 620 moves the oil mist filter 513 again, an end of the oil mist filter 513 may be exposed to the upper side of the head 100, as illustrated in FIG. 1. As illustrated in FIG. 1, maintaining the exposure of the end of the oil mist filter 513 to the upper side of the head 100 when using the oil mist filter 513 is provided as an example, and the oil mist filter 513 may be controlled to expose an end thereof to the upper side of the head 100 only when cutting the end of the oil mist filter 513.

Figure 25:
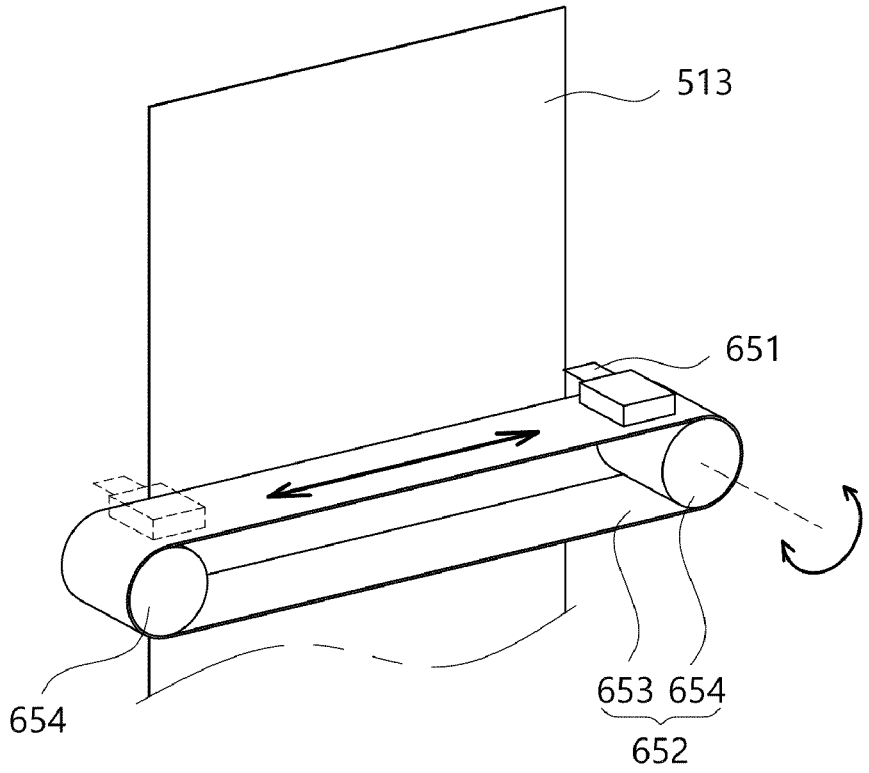

FIG. 25 is a view illustrating cutting unit according to an embodiment. Cutting unit 650 may include a cutter 651 that cuts the oil mist filter 513. Further, the cutting unit 650 may include a cutter moving unit or mover 652 configured to transversely reciprocate the cutter 651 such that the oil mist filter 513 is transversely cut.

For example, the cutter moving unit 652 may include a belt 653 and a pair of pulleys 654. In a state in which the cutter 651 is installed at the belt 653, when one of the pair of pulleys 654 performs forward and reverse rotations, the cutter 651 installed at the belt 653 may transversely cut the oil mist filter 513 while reciprocating along the belt 653.

As illustrated in FIG. 3, the filter roll 610 according to an embodiment may be installed in the roll mounting portion 142 such that the oil mist filter 513 wound on the filter roll 610 is unwound at the lower portion of the head main body 130 in a direction covering the lower portion of the head main body 130 and extends toward the lower portion of the suction inlet 110. Further, the oil mist filter 513 moving past the suction inlet 110 may bend upward and may be moved to the upper side of the head 100 by the filter transportation unit 620. With this configuration, the oil mist filter 513 unwound from the filter roll 610 may be moved by being bent only in one direction, so that efficient movement of the oil mist filter 513 by the filter transportation unit 620 may be performed.

In addition, the upper casing 150 according to an embodiment may include a filter discharge hole 151 formed vertically therethrough. Accordingly, the end of the oil mist filter 513 moved by the filter transportation unit 620 may be moved to the upper side of the head 100 through the filter discharge hole 151 formed in the upper casing 150 and may be discharged to the outside of the head 100.

Figure 26:
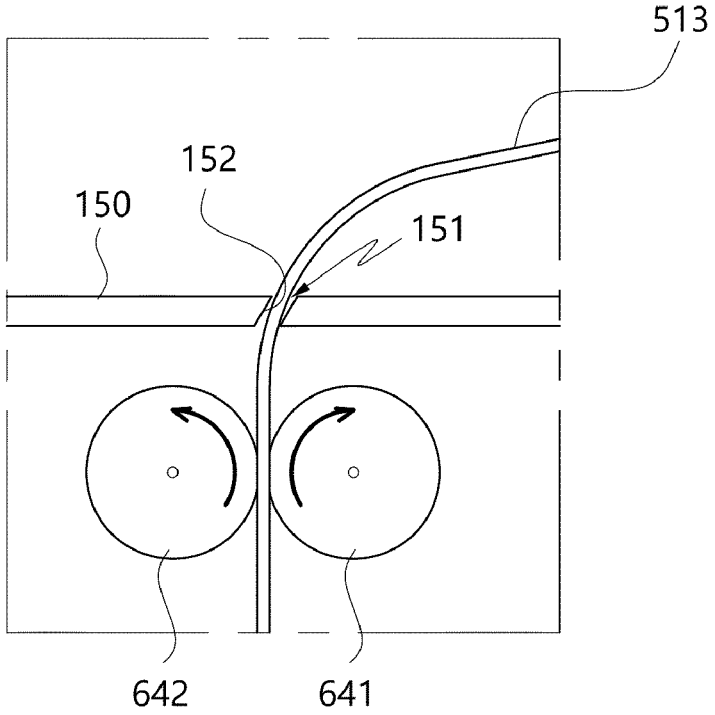

As illustrated in FIG. 26, the filter discharge hole 151 according to an embodiment may include an inclined surface 152. The inclined surface 152 may be formed on an inner wall surface of the filter discharge hole 151 and may be inclined toward the discharge outlet 120 such that the oil mist filter 513 is discharged toward the discharge outlet 120 when the oil mist filter 513 is discharged through the filter discharge hole 151.

With this configuration, the oil mist filter 513 moved by being unwound from the filter roll 610 may be moved by being bent only in one direction, and thus, efficient movement of the oil mist filter 513 may be performed. Additionally, when the oil mist filter 513 is discharged to the upper side of the head 100, the oil mist filter 513 may be discharged toward the discharge outlet 120 located at a side opposite to a burner, so accidents due to discharging of the oil mist filter 513 toward the burner may be prevented.

Figure 27:
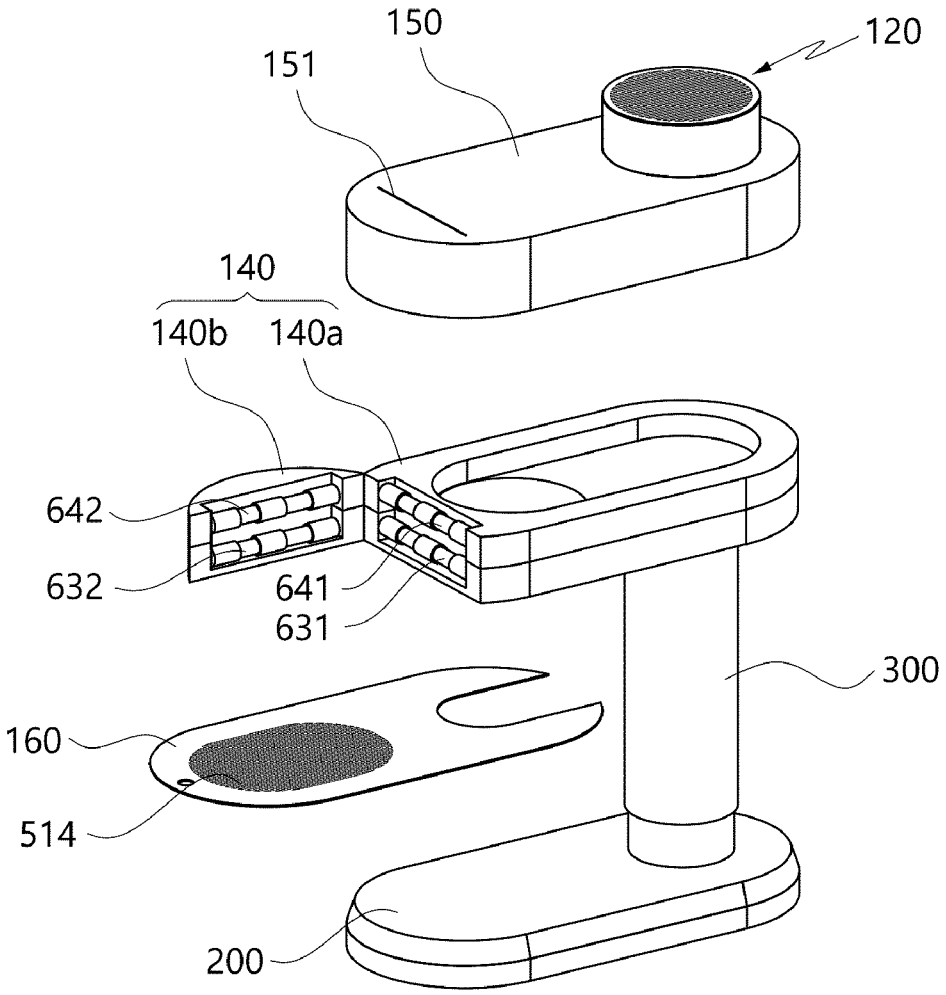

As illustrated in FIG. 27, for example, the casing main body 140 according to an embodiment may include a first casing main body **140*a* and a second casing main body 140*b*. The first casing main body 140*a* according to this embodiment may be a major part of the casing main body 140 according to an embodiment. For example, the suction inlet 110 and the roll mounting portion 142 may be formed in the first casing main body 140*a*. Additionally, the first casing main body 140*a* may include flow space 141 formed therein to seat flow path 170 in the flow space 141 and may be coupled to the column 300**.

The second casing main body **140*b* according to an embodiment may be coupled to the first casing main body 140*a* by a vertical hinge. Accordingly, as illustrated in FIG. 27, the second casing main body 140*b* may open and close the first casing main body 140*a*** in a horizontal direction.

When the second casing main body **140*b* opens the first casing main body 140*a*, the filter transportation unit 620 installed in the casing main body 140 may be exposed to the outside, as illustrated in FIG. 27. Accordingly, after the second casing main body 140***b* is opened, the first roller unit 630 and the second roller unit 640 may be removed from the casing main body 140, so that the first roller unit 630 and the second roller unit 640 used for a predetermined period of time may be washed.

The first moving roller 631 of the first roller unit 630 and the first moving roller 641 of the second roller unit 640 may be installed in the first casing main body 140*a*. Further, the second moving roller 632 of the first roller unit 630 and the second moving roller 642 of the second roller unit 640 may be installed in the second casing main body 140*b*. Accordingly, when the second casing main body 140*b* closes the first casing main body 140*a*, the oil mist filter 513 may be fitted between the first moving roller 631 or 641 and the second moving roller 632 or 642, so that replacement of the filter roll 610 may be further efficiently performed.

FIGS. 28A, 28B, 28C, 28D, 29A, 29B, and 29C are views illustrating a process in which a filter roll is newly mounted in a portable hood according to an embodiment. FIGS. 28A, 28B, 28C, 28D, 29A, 29B, and 29C show only reference numerals necessary for description so that the configurations of the illustrated drawings may be more clearly identified.

Figure 28A:
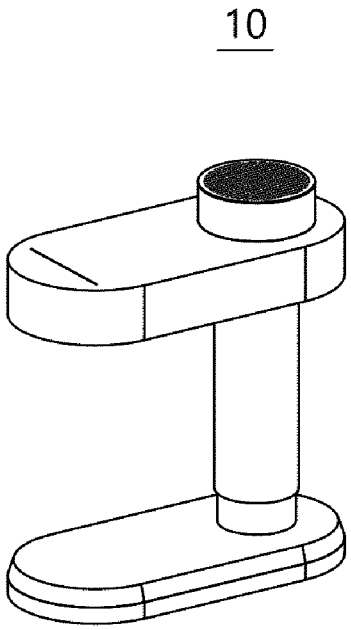
FIGS. 28A, 28B, 28C, 28D, 29A, 29B, and 29C are views illustrating a process in which a filter roll is newly mounted in a portable hood according to an embodiment.
Figure 28B:
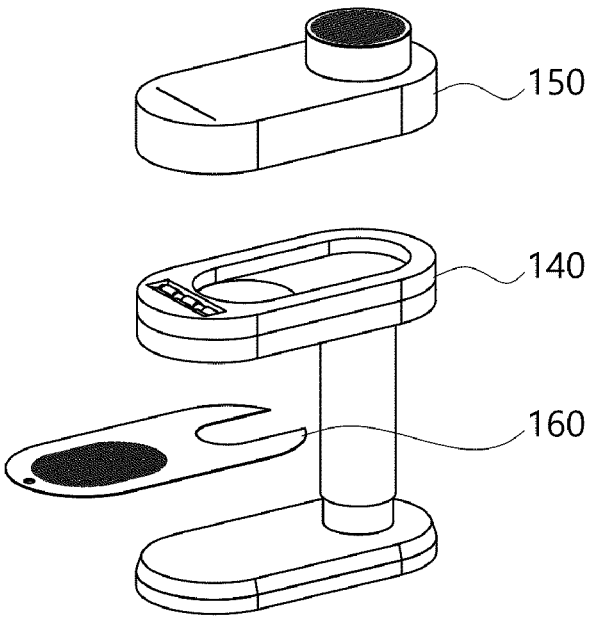
Figure 28C:
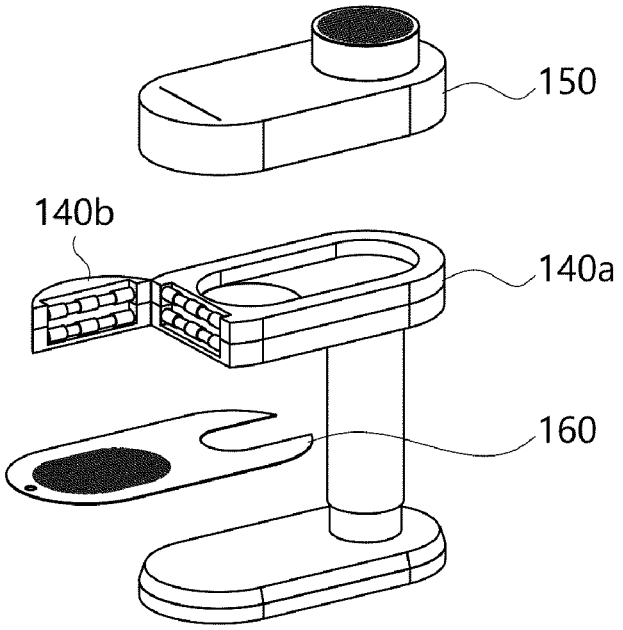

Referring to FIGS. 28A, 28B, 28C, 28D, 29A, 29B, and 29C, as illustrated in FIG. 28A, in a state in which the portable hood 10 according to an embodiment is assembled, first, the upper casing 150 and the lower casing 160 may be removed from the casing main body 140, as illustrated in FIG. 28B. Next, as illustrated in FIG. 28C, a front of the first casing main body 140*a* may be opened by rotating the second casing main body 140*b* relative to the first casing main body 140*a*. In this case, as described above, the first moving roller 631 or 641 is installed in the first casing main body 140*a*, and the second moving roller 632 or 642 is installed in the first casing main body 140*a*.

Figure 28D:
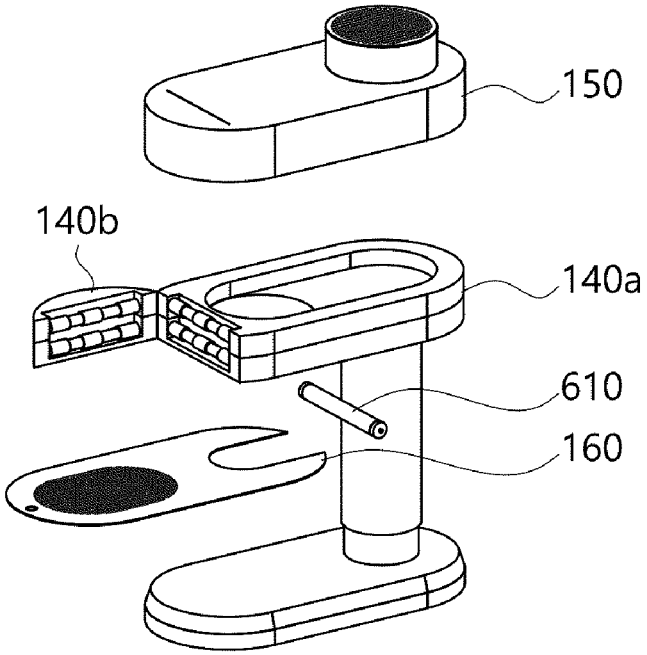
Figure 29A:
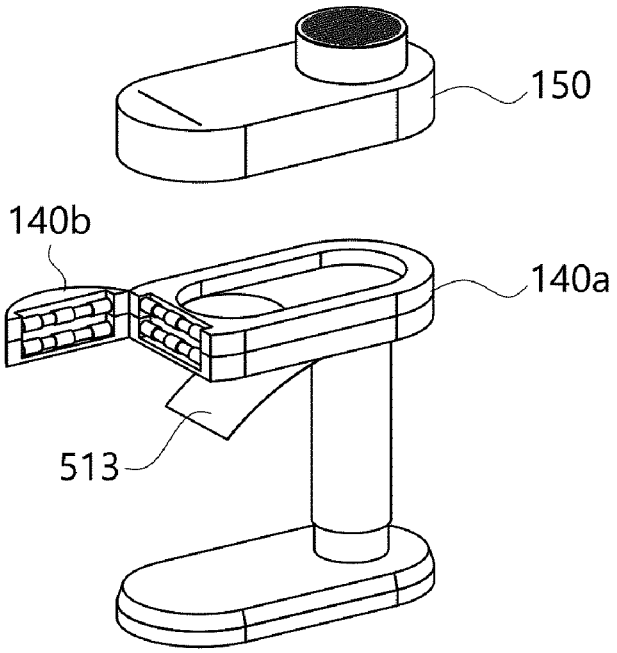
Figure 29B:
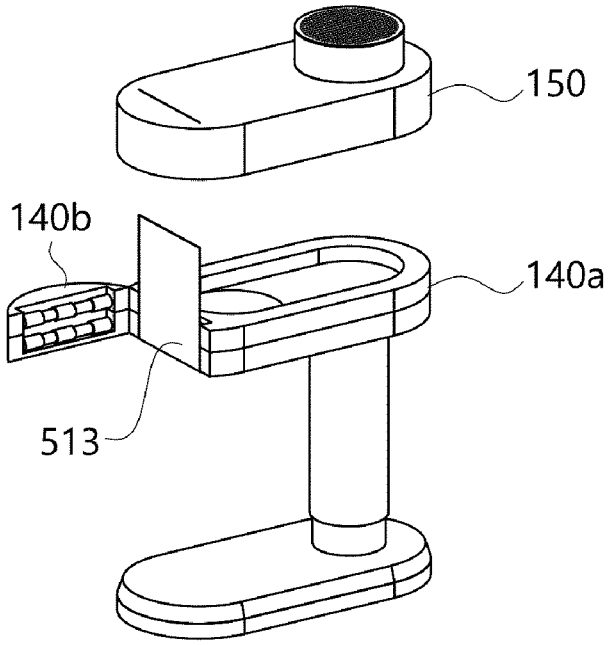

Next, as illustrated in FIG. 28D, the filter roll 610 may be mounted to the roll mounting portion 142 formed at the lower surface of the first casing main body 140*a* according to the method described above. Next, as illustrated in FIG. 29A, the oil mist filter 513 may be unwound by pulling the end of the oil mist filter 513 from the filter roll 610 mounted to the roll mounting portion 142 and may be bent at the front end of the first casing main body 140*a*, and as illustrated in FIG. 29B, the oil mist filter 513 may be directed upward. In this case, a flat surface of a side of the oil mist filter 513 may be in close contact with the front of the first moving roller 631 or 641 installed in the first casing main body 140*a*.

Figure 29C:
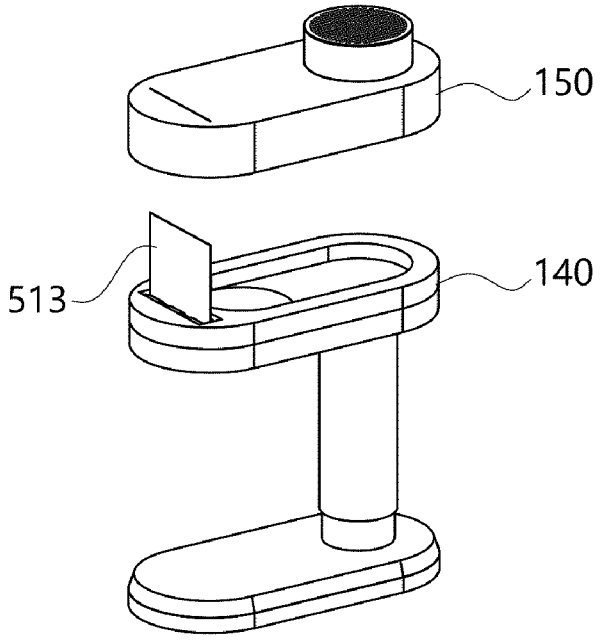

Next, as illustrated in FIG. 29C, when the front of the first casing main body 140*a* is closed by rotating the second casing main body 140*b*, the oil mist filter 513 may be located between the first moving roller 631 or 641 and the second moving roller 632 or 642 and may be held therebetween, with the end of the oil mist filter 513 exposed to the upper side of the casing main body 140.

Next, when the upper casing 150 and the lower casing 160 are coupled to the casing main body 140, as illustrated in FIG. 1, installation of the oil mist filter 513 may be completed by exposing the end of the oil mist filter 513 to the upper side of the head 100. In a process of coupling the upper casing 150 to the casing main body 140, the coupling of the upper casing 150 to the casing main body 140 may be performed after passing the end of the oil mist filter 513 through the filter discharging hole 151.

As another example, as for the process of coupling the lower casing 160 to the casing main body 140, in a state illustrated in FIG. 29B, the lower casing 160 may first be coupled to the first casing main body 140*a* and then the second casing main body 140*b* may be rotated.

In the embodiment described above, the filter unit 500 installed at the suction inlet 110 includes the deodorization filter 512, the oil mist filter 513, and the pre-filter 514, which are made of a non-woven fabric, corrugated activated carbon, and aluminum mesh, respectively. This is because the portable hood 10 according to the above-described embodiment is suitable for removing oil vapor generated during cooking.

As another example, the portable hood 10 according to an embodiment may be configured to function as an air purifier. As described above, the deodorization filter 512 may be replaced through the suction inlet 171 of the casing main body 140, and the oil mist filter 513 may be replaced through replacement of the filter roll 610. Likewise, the pre-filter 514 may be detachably installed at the lower casing 160.

For operation of the portable hood as an air purifier, a user may replace the deodorization filter 512, the oil mist filter 513, or the pre-filter 514 according to the embodiment described above with a filter suitable for air purification to be used, so that the scope of use of the portable hood 10 according to embodiments may expand.

For example, pre-filter 514 may be replaced with a plastic mesh filter suitable for the air purifier. Further, a HEPA filter and a deodorization filter may be installed sequentially at a position at which the deodorization filter 512 described above is installed. In this case, a user may use the portable hood as the air purifier with the oil mist filter 513 unremoved or removed.

Accordingly, embodiments disclosed herein have been made keeping in mind problems occurring in the related art, and are intended to propose a portable hood which is changeable in installation position.

Embodiments disclosed herein provide a portable hood which maintains a stable standing state to remove the possibility of tipping over during use such that stable cooking may be performed. Further, embodiments disclosed herein provide a portable hood that draws oil vapor generated during cooking thereinto at a position adjacent to an upper portion of a cooking utensil, such as a pot, such that efficiency of drawing the oil vapor is increased. Additionally, embodiments disclosed herein provide a portable hood in which a suction inlet is adjusted such that the suction inlet is placed above a cooking utensil according to a height or position of the cooking utensil.

Furthermore, embodiments disclosed herein provide a portable hood in which oil vapor is prevented from bypassing the suction inlet without being introduced to the suction inlet. Additionally, embodiments disclosed herein provide a portable hood in which oil vapor is introduced through the suction inlet and discharged upward such that the oil vapor is efficiently removed through cooperation of the portable hood with a fixed hood installed in a kitchen.

In addition, embodiments disclosed herein provide a portable hood in which main components are easily disassembled and then washed such that cleanliness of the main components is maintained. Further, embodiments disclosed herein provide a portable hood which in addition to a function of removing oil vapor during cooking, has an air cleaning function.

A portable hood according to embodiments disclosed herein may include a base unit or base, a head unit or head, a columnar unit or column, and a drawing-force generation part or fan. The base unit according to embodiments disclosed herein may sit on a foundation.

The head unit according to embodiments disclosed herein may introduce air thereto and may discharge the introduced air to the outside. The column according to embodiments disclosed herein may connect the head unit with the base unit such that the head unit is spaced upward apart from the base. The columnar unit may be coupled to the head unit to be biased to a horizontal side thereof.

The drawing-force generation part according to embodiments disclosed herein may be installed in the head unit and may generate a suction force. The drawing-force generation part may be located in the head such that the drawing-force generation part is biased to a horizontal side of the head to correspond to the column.

The head unit according to embodiments disclosed herein may include a suction inlet and a discharge outlet. Air may be introduced into the suction inlet according to embodiments disclosed herein, and the air introduced through the suction inlet may be discharged to the outside through the discharge outlet.

In embodiments disclosed herein, the suction inlet and the discharge outlet may be formed to be eccentric to each other in a horizontal direction relative to a vertical direction. The discharge outlet may be located to be biased in a direction toward the columnar unit from the suction inlet.

The columnar unit according to embodiments disclosed herein may be rotatably coupled to the base unit such that the suction inlet of the head unit is rotatable side to side in a horizontal direction.

The drawing-force generation part according to embodiments disclosed herein may be installed in the discharge outlet and may include a discharge fan configured to generate a suction force for introducing air to the discharge outlet. The discharge fan may be installed in the head unit such that the discharge fan is located at the upper side of the columnar unit.

In addition, the drawing-force generation part according to embodiments disclosed herein may further include a fan motor configured to rotate the discharge fan. The fan motor may be installed in the head unit such that the fan motor is located at the upper side of the columnar unit.

The discharge fan and a rotational shaft of the fan motor may be installed vertically, and the discharge fan and the fan motor may be installed in the head such that the rotational shaft of the fan motor is located inside of the columnar unit. The fan motor, the discharge fan, and the columnar unit may be installed such that the central axes of the fan motor, the discharge fan, and the columnar unit correspond to each other.

The head unit according to embodiments disclosed herein may include a head main body and a flow-path portion or flow path. The suction inlet and the discharge outlet may be formed in the head unit such that the suction inlet and the discharge outlet are eccentric to each other in a horizontal direction. Further, the flow-path portion may be provided inside of the head main body such that air introduced through the suction inlet flows to the discharge unit through the flow path.

The discharge fan and the fan motor may be vertically arranged with the flow-path portion placed between the discharge fan and the fan motor. The flow-path portion may include an inlet, a filter discharge hole, and an inner flow path. The inlet may be open toward the suction inlet, and the filter discharge hole may be open toward the discharge outlet. Additionally, the inner flow path may communicate the inlet with the filter discharge hole in a horizontal direction.

The inlet and the filter discharge hole may be formed in the flow-path portion such that the inlet and the filter discharge hole do not vertically overlap. The discharge fan and the fan motor may be installed in the head unit such that the discharge fan and the fan motor are located at upper and lower sides, respectively, of the filter discharge hole.

The columnar unit according to embodiments disclosed herein may be coupled to the base unit such that the columnar unit is horizontally eccentric to the base unit. In a short length direction of the horizontal cross-section of each of the base unit and the head unit, a width of the base unit may be equal to or wider than a width of the head unit.

The portable hood according to embodiments disclosed herein may further include a weight plate. The weight plate may be provided inside of the base unit and may prevent the columnar unit and the head unit from tipping over. The weight plate may be made of metal.

The portable hood according to embodiments disclosed herein may further include a battery module. The battery module may be installed inside of the columnar unit and may supply power required for operating the fan motor. The battery module may be installed at a lower side of the inside of the columnar unit. Each of a plurality of battery modules may be horizontally arranged inside of the columnar unit by standing.

The portable hood according to embodiments disclosed herein may have at least the following advantages.

First, in a state in which the column is coupled eccentrically to a side of the head in a horizontal direction, the fan may be located eccentrically to a side of the column, and a center of weight of the portable hood may be formed at the side of the column, thereby preventing tipping over of the portable hood.

Second, components, such as a weight plate and a battery module, may be arranged in the base or the column such that the center of weight of the portable hood is located at the column or a lower portion of the portable hood, thereby enabling stable standing of the portable hood such that the portable hood is prevented from tipping over.

Third, the suction inlet and the discharge outlet may be formed at eccentric positions in a horizontal direction, thereby removing bypassing of air occurring when the suction inlet and the discharge outlet are positioned on a same axis in a vertical direction and improving efficiency of drawing and discharging air.

Fourth, the suction inlet and the discharge outlet may be formed at eccentric positions in a horizontal direction, a flow of air introduced to the suction inlet and a flow of air discharged from the discharge outlet may not affect each other, thereby improving efficiency of drawing and discharging air.

Fifth, the head may be provided to rotate horizontally relative to the base, and the suction inlet may be adjusted to be located adjacently to an upper portion of a cooking utensil according to a cooking environment, such as a position of a burner being used. Accordingly, the portable hood may draw oil vapor thereto at the position adjacent to the upper portion of the cooking utensil, thereby increasing efficiency of drawing the oil vapor.

Sixth, the discharge outlet may be configured to discharge oil vapor in an upward direction, and the oil vapor may be discharged in a direction toward a fixed hood, thereby effectively removing the oil vapor generated during cooking in cooperation with the fixed hood.

Seventh, the fan motor configured to rotate the discharge fan may be located under a flow path in which oil vapor flows, thereby preventing contamination of the fan motor due to the oil vapor. Further, due to prevention of the contamination of the fan motor, the fan motor may not be required to be disassembled during disassembly of the portable hood to wash the portable hood, thereby simplifying disassembling and washing of the portable hood.

Eighth, the head main body may be removed from the casing main body and the upper casing, and the flow path providing communication between the suction inlet and the discharge outlet may be removed from the casing main body, thereby enabling washing of the flow path in which the oil vapor flows.

Ninth, the fan housing receiving the discharge fan may protrude from the head, thereby slimming an entire vertical thickness of the head main body receiving the discharge fan and the fan motor.

Tenth, disassembly of the head may be easy, thereby facilitating washing and replacement of the discharge fan, the flow path, and a purification filter, such as a deodorization filter installed in the head.

Eleventh, the lower casing may be removed from the casing main body, thereby facilitating replacement of an oil mist filter provided as a roll filter through a hinged coupling between a first casing main body and a second casing main body.

Twelfth, an end of the oil mist filter discharged to the upper side of the head unit may be configured to be discharged to the discharge outlet located at a side opposite to a burner, thereby preventing accidents which may occur during discharge of the end of the oil mist filter to the burner.

Thirteenth, the head may be configured to have an adjustable height, thereby effectively drawing and discharging oil vapor according to cooking utensils having various heights without affecting cooking.

Fourteenth, the purification filter constituting the filter may be replaced, thereby functioning as an air purifier by replacing a purification filter used during cooking with the purification filter for air purification.

The embodiments have been described above with reference to the accompanying drawings, but the embodiments are not limited to the above embodiments and may be manufactured in various forms. Those skilled in the art to which the embodiments pertain will understand that the embodiments may be implemented in other specific forms without changing the technical spirit or essential features. Therefore, it should be understood that the embodiments described above are illustrative in all respects and not restrictive.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A portable hood, comprising:
a base configured to sit on a foundation;
a head configured to introduce air thereinto and to discharge the introduced air to the outside;
a column that connects the head with the base such that the head is spaced upward apart from the base; and
a fan installed inside of the head and configured to generate a suction force, wherein the column is coupled to the head to be biased to a horizontal side thereof, and the fan is located inside of the head such that the fan is located above the column, wherein the head comprises:
a suction inlet through which air is introduced, and a discharge outlet through which air introduced through the suction inlet is discharged to the outside, and wherein the suction inlet and the discharge outlet are eccentric with respect to each other in a horizontal direction relative to a vertical direction, and the discharge outlet is biased toward the column from the suction inlet.

2. The portable hood of claim 1, wherein the column is rotatably coupled to the base such that the suction inlet of the head is rotatable side to side in the horizontal direction.

3. The portable hood of claim 2, wherein the fan comprises a discharge fan installed in the discharge outlet and configured to generate the suction force for introducing air thereinto, and wherein the discharge fan is installed in the head such that the discharge fan is located above the column.

4. The portable hood of claim 3, wherein the fan further comprises a fan motor configured to rotate the discharge fan, and wherein the fan motor is installed in the head such that the fan motor is located at an upper side of the column.

5. The portable hood of claim 4, wherein the discharge fan and a rotational shaft of the fan motor extend vertically, and wherein the discharge fan and the fan motor are installed in the head such that the rotational shaft of the fan motor is located inside of the column.

6. The portable hood of claim 5, wherein the fan motor, the discharge fan, and the column are installed such that central axes of the fan motor, the discharge fan, and the column correspond to each other.

7. The portable hood of claim 5, wherein the head further comprises:
a head main body configured such that the suction inlet and the discharge outlet are horizontally eccentric with respect to each other, and wherein a flow path is formed inside of the head main body such that the air introduced through the suction inlet flows to the discharge outlet through the flow path.

8. The portable hood of claim 7, wherein the discharge fan and the fan motor are vertically arranged with the flow path between the discharge fan and the fan motor.

9. The portable hood of claim 8, wherein the flow path comprises:
an inlet which is open downward toward the suction inlet;
a filter discharge hole which is open upward toward the discharge outlet; and
an inner flow path that provides communication between the inlet and the filter discharge hole.

10. The portable hood of claim 9, wherein the inlet and the filter discharge hole are formed in the flow path such that the inlet and the filter discharge hole do not vertically overlap each other.

11. The portable hood of claim 10, wherein the discharge fan and the fan motor are installed in the head such that the discharge fan and the fan motor are located at upper and lower sides, respectively, of the filter discharge hole.

12. The portable hood of claim 3, wherein the column is coupled to the base such that the column is horizontally eccentric to the base.

13. The portable hood of claim 11, wherein, in a shortest length direction of a horizontal cross-section of each of the base and the head, a width of the base is equal to or wider than a width of the head.

14. The portable hood of claim 12, further comprising:
a weight plate made of metal provided inside of the base, the weight plate preventing the column and the head from tipping over.

15. The portable hood of claim 3, further comprising:
a battery module installed inside of the column and configured to supply power required for operating a fan motor.

16. The portable hood of claim 15, wherein the battery module is installed at a lower portion of the column thereinside.

17. The portable hood of claim 15, wherein the battery module comprises a plurality of battery modules arranged horizontally inside of the column and standing up.

18. A portable hood, comprising:
a base;
a head configured to introduce air thereinto and to discharge the introduced air to the outside;
a column that connects the head with the base such that the head is spaced upward apart from the base, the column being rotatably coupled to the base such that a suction inlet of the head is laterally rotatable within a predetermined angle range; and
a fan installed inside of the head and configured to generate a suction force, wherein the column is coupled to the head at one end thereof in a longitudinal direction, and the fan is located inside of the head such that the fan is located above the column, wherein the head comprises:
a suction inlet through which air is introduced, and a discharge outlet through which air introduced through the suction inlet is discharged to the outside, and wherein the suction inlet and the discharge outlet are eccentric with respect to each other in a horizontal direction relative to a vertical direction, and the discharge outlet is biased toward the column from the suction inlet.

19. A portable hood, comprising:
a base;
a head configured to introduce air thereinto and to discharge the introduced air to the outside;
a column that connects the head with the base such that the head is spaced upward apart from the base, the column being rotatably coupled to the base such that a suction inlet of the head is laterally rotatable; and
a fan installed inside of the head and configured to generate a suction force, wherein the column is coupled to the head at one end thereof in a longitudinal direction, and the fan is located inside of the head such that the fan is located above the column, and wherein a lateral width of the base is equal to or wider than a lateral width of the head, wherein the head comprises:
a suction inlet through which air is introduced, and a discharge outlet through which air introduced through the suction inlet is discharged to the outside, and wherein the suction inlet and the discharge outlet are eccentric with respect to each other in a horizontal direction relative to a vertical direction, and the discharge outlet is biased toward the column from the suction inlet.

* * * * *